US008371023B2

(12) United States Patent
Kishimoto

(10) Patent No.: US 8,371,023 B2
(45) Date of Patent: Feb. 12, 2013

(54) SPOUT INSTALLATION DEVICE

(75) Inventor: Syuuichi Kishimoto, Sakai (JP)

(73) Assignee: Fuji Seal International, Inc. (JP)

( * ) Notice: Subject to any disclaimer, the term of this patent is extended or adjusted under 35 U.S.C. 154(b) by 505 days.

(21) Appl. No.: 12/667,655

(22) PCT Filed: Jul. 1, 2008

(86) PCT No.: PCT/JP2008/001713

§ 371 (c)(1),
(2), (4) Date: Jan. 4, 2010

(87) PCT Pub. No.: WO2009/004788

PCT Pub. Date: Jan. 8, 2009

(65) Prior Publication Data

US 2010/0192367 A1 Aug. 5, 2010

(30) Foreign Application Priority Data

Jul. 5, 2007 (JP) ..... 2007-176977

(51) Int. Cl.
*B23P 21/00* (2006.01)

(52) U.S. Cl. ..... 29/771; 29/773; 29/783; 29/791; 29/430; 53/133.2; 493/87

(58) Field of Classification Search ..... 29/429, 29/430, 771, 773, 783, 791; 53/133.2, 422; 493/87

See application file for complete search history.

(56) References Cited

U.S. PATENT DOCUMENTS

| | | | | |
|---|---|---|---|---|
| 6,751,928 | B2 * | 6/2004 | Hiramoto et al. | 53/133.2 |
| 2004/0011001 | A1 * | 1/2004 | Hiramoto | 53/133.2 |
| 2006/0199716 | A1 * | 9/2006 | Tsutsui et al. | 493/87 |
| 2007/0105698 | A1 | 5/2007 | Nagano et al. | |

FOREIGN PATENT DOCUMENTS

| | | | |
|---|---|---|---|
| EP | 1775113 | A1 | 4/2007 |
| JP | 4-62040 | A | 2/1992 |
| JP | 2000-6999 | A | 1/2000 |
| JP | 2003-311851 | A | 11/2003 |
| JP | 2005-59426 | A | 3/2005 |
| WO | 2006/001244 | A1 | 1/2006 |

OTHER PUBLICATIONS

International Search Report for PCT/JP2008/001713 mailed Oct. 7, 2008 with English translation.

* cited by examiner

*Primary Examiner* — Jermie Cozart
(74) *Attorney, Agent, or Firm* — Cantor Colburn LLP

(57) ABSTRACT

A spout installation device capable of reliably installing spouts onto correct positions on a pouch. The spout installation device has a pouch supply section for supplying a pouch (P), first and second spout supply sections for respectively supplying an inlet spout (SA) and an outlet spout (SB), and first and second spout installation sections for installing the inlet spout (SA) and the outlet spout (SB), which are supplied by the spout supply sections, onto the pouch (P) supplied by the pouch supply section. For each time of installation of the inlet spout (SA) and the outlet spout (SB) onto the pouch (P), an upper inclined edge and a lower edge of the pouch (P) are positioned by a positioning unit of the pouch supply section and by a positioning/holding mechanism of the second spout installation section.

3 Claims, 34 Drawing Sheets

ROW A
ROW B
211
PC
214

SPOUT INSTALLATION DEVICE

CROSS REFERENCE TO RELATED APPLICATIONS

This is a U.S. national stage of application No. PCT/JP2008/001713 filed on 1 Jul. 2008. Priority under 35 U.S.C. §119(a) and 35 U.S.C. §365(b) is claimed from Japanese Application No. 2007-176977, filed 5 Jul. 2007, the disclosure of which is also incorporated herein by reference.

TECHNICAL FIELD

The present invention relates to a spout installation device that can install a plurality of spouts onto a pouch.

BACKGROUND ART

FIG. 35 illustrates an example of the spout installation device. A spout installation device 50, as illustrated in FIGS. 36(*a*) and 36(*b*), can install two types of spouts S1 and S2 onto opposed edges E1 and E2 of a pouch P. Installation of the spouts S1 and S2 onto the pouch P can be performed in the following manner. A pouch P on which the spouts S1 and S2 are not yet installed, as illustrated in FIG. 36 (*b*), is preliminarily heat sealed along its peripheral edge except for installation portions of the spouts S1 and S2. In FIGS. 36(*a*) and 36(*b*), a portion indicated by half-tone dot meshing is a heat sealed portion.

As illustrated in FIG. 35, the spout installation device 50 performs an operation for suction holding an uppermost pouch P from a pouch stocker 51, which can store a plurality of pouches P accumulated in the up-and-down direction. Then, the spout installation device 50 successively mounts the pouches P on a conveyor 52. The spout installation device 50 includes a pair of side guides 53 that can regulate the pouch P at both ends thereof in a width direction while the pouch P is conveyed by the conveyor 52. The spout installation device 50 causes the pouch P to collide, at one edge E1 onto which the spout S1 can be installed, with a stopper 54 that is disposed on an upstream side of the conveyor 52 in a conveyance direction, thereby positioning the pouch P. Then, the spout installation device 50 performs an operation for suction holding the pouch P in this state and placing the pouch P on a bucket 55. Further, the spout installation device 50 fixes the pouch P at one side edge thereof to the bucket 55 by means of clips 55*a*.

Subsequently, as illustrated in FIG. 35, the spout installation device 50 performs an operation for transporting the bucket 55 mounting the pouch P in a direction perpendicular to the conveyance direction of the pouch P by the conveyor 52. The spout installation device 50 includes a plurality of stations that can perform sequential processes of [preliminary opening of the edge E1]→[opening of the edge E1, insertion of the spout S1 into the opened edge E1, and temporary seal of the spout S1]→[permanent seal 1 of the spout S1]→[permanent seal 2 of the spout S1] ([opening of the edge E2, insertion of the spout S2 into the opened edge E2, and temporary seal of the spout S2])→[permanent seal 3 of the spout S1] ([permanent seal 1 of the spout S2])→[cooling of the sealed portion at the edge E1] ([permanent seal 2 of the spout S2])→[cooling of the sealed portion at the edge E2] to accomplish the installation of the spouts S1 and S2 onto the pouch P.

Patent Document 1: JP 2000-6999 A

DISCLOSURE OF THE INVENTION

Problems to be Solved by the Invention

According to the above-described spout installation device 50, the pouch P is positioned when one edge E1 onto which the spout S1 can be installed collides with the stopper 54. Then, the pouch P is mounted on and fixed to the bucket 55. Therefore, an installation position of the spout S1 relative to the pouch P can be set accurately. The spout installation device 50 can appropriately install the spout S1 onto the pouch P. However, due to the dimension accuracy and curvature of the pouch P itself or a deflection of the pouch P that may occur when the spout S1 is installed, a positional deviation may occur at the edge E2 of the pouch P onto which the spout S2 can be installed. Therefore, the spout S2 may not be appropriately installed onto a predetermined position on the pouch P.

An object of the present invention is to provide a spout installation device that can accurately install a plurality of spouts onto correct positions on a pouch.

Means for Solving the Problems

To solve the above-described problems, the invention defined in claim 1 is directed to a spout installation device that can install a plurality of spouts onto a pouch, including a pouch supply section for supplying a pouch; a plurality of spout supply sections for respectively supplying a plurality of spouts; and a plurality of spout installation sections for installing the spouts, which are respectively supplied by the plurality of spout supply sections, onto the pouch supplied by the pouch supply section. Further, a plurality of positioning means are provided to position spout installation edges of the pouch onto which respective spouts can be installed each time when respective spouts are installed on the pouch.

Further, at least an embodiment is characterized in that one positioning means of the plurality of positioning means includes, a spout holding member that holds a spout, a positioning unit that positions the pouch by causing the spout installation edge of the pouch to abut, and a pouch transport unit that includes a holding opening means for opening the spout installation edge while holding the pouch positioned by the positioning unit and an auxiliary holding means for holding the pouch to be variable in orientation and position, wherein the holding opening means of the pouch transport unit opens the spout installation edge while holding the pouch positioned by the positioning unit, the opened spout installation edge of the pouch is coupled with an installation portion of the spout by conveying the pouch in this state so that a flange portion of the spout is held in a state where the flange portion of the spout is slightly separated from the spout installation edge of the pouch, and the holding of the pouch by the holding opening means is released in a state where the pouch is held by the auxiliary holding means, to cause the pouch and the spout to approach to each other, thereby positioning the pouch by pressing the spout installation edge of the pouch against the flange portion of the spout.

Moreover, at least an embodiment is characterized in that one positioning means of the plurality of positioning means includes pouch hanging means for hanging the pouch in a freely swingable state and a positioning member that can approach to and depart from the spout installation edge of the pouch that is hung by the pouch hanging means, wherein the pouch is positioned by pressing the positioning member against the spout installation edge of the pouch that is hung by the pouch hanging means.

Advantages of the Invention

As described above, the spout installation device according to at least an embodiment can position a spout installation edge of a pouch onto which a spout can be installed each time when each spout is installed on the pouch. Therefore, the spout installation device according to the present invention can accurately install a plurality of spouts onto correct positions on the pouch without being adversely influenced by the dimension accuracy and curvature of the pouch itself or a deflection of the pouch that may occur due to the weight of a previously installed spout, at the time when each spout is installed on the pouch.

As described above, in the spout installation device according to at least an embodiment, one positioning means can cause the pouch transport unit to couple an opened spout installation edge of the pouch preliminarily positioned by the positioning unit with an installation portion of the spout so that a flange portion of the spout is held in a state where the flange portion of the spout is slightly separated from the spout installation edge of the pouch. Then, in a state where the pouch is held by the auxiliary holding means so as to be variable in orientation and position, the pouch is positioned by pressing the spout installation edge of the pouch against the flange portion of the spout. Therefore, the spout installation device can accurately install the spout onto the spout installation edge of the pouch.

As described above, in the spout installation device according to at least an embodiment, one positioning means can position the pouch by pressing the positioning member against the spout installation edge of the pouch that is hung in a freely swingable state by the pouch hanging means. Therefore, the spout installation device can accurately install the spout onto the spout installation edge of the pouch while the pouch is carried in a hanging state.

BRIEF DESCRIPTION OF THE DRAWINGS

FIG. 3(*b*) is a left side view illustrating the pouch cassette illustrated in FIG. 3(*a*).

FIG. 3(*c*) is a front view illustrating the pouch cassette illustrated in FIG. 3(*a*).

FIG. 3(*d*) is a right side view illustrating the pouch cassette illustrated in FIG. 3(*a*).

FIG. 3(*e*) is a rear view illustrating the pouch cassette illustrated in FIG. 3(*a*).

FIG. 17(*b*) is a plan view illustrating an intermediate frame, a suction holding member, and a second rotational driving mechanism that constitute the pouch takeout unit illustrated in FIG. 9.

FIG. 20(*b*) is a front view illustrating a damper-opener that constitutes the pouch transport unit illustrated in FIG. 19.

FIG. 20(*c*) is a front view illustrating an auxiliary damper that constitutes the pouch transport unit illustrated in FIG. 19.

FIG. 30(*b*) is a plan view illustrating the positioning-gripping mechanism and the second clamp mechanism illustrated in FIG. 27.

FIG. 34(*b*) is a plan view illustrating the pouch on which the inlet spout and the outlet spout illustrated in FIG. 4(*a*) are installed.

FIG. 36(*b*) is a plan view illustrating the pouch on which the spout is installed.

REFERENCE NUMERALS

Figure 1:
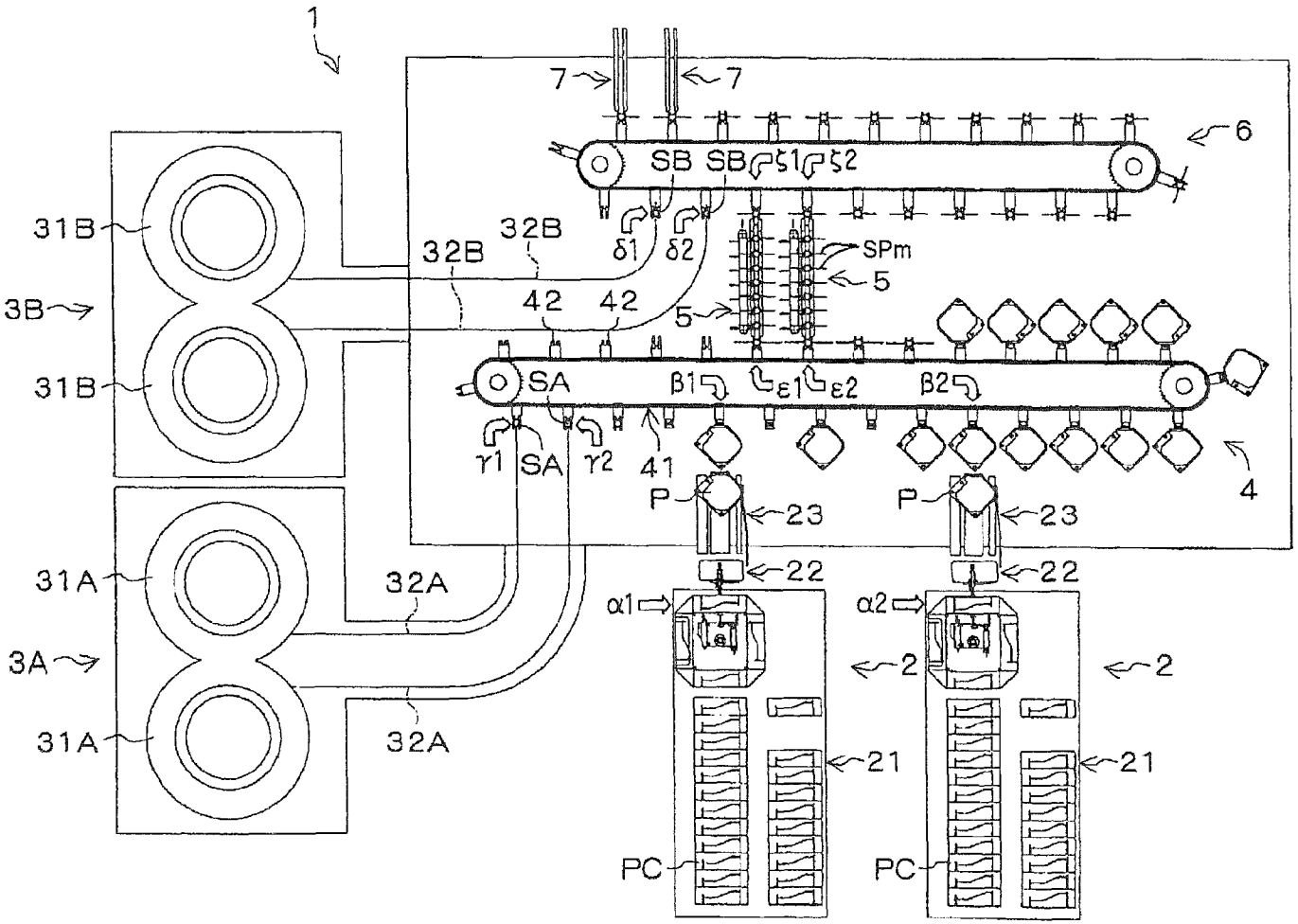
FIG. 1 is a plan view schematically illustrating an embodiment of a spout installation device according to the present invention.

1 spout installation device
2 pouch supply section
3A first spout supply section
3B second spout supply section
4 first spout installation section
5 transfer section
6 second spout installation section
7 delivery section
21 pouch stocker
211 cassette mounting base
211*b* base plate
211*c* guide plate
212 cassette transport mechanism
213*a* to 213*d* pusher
214 transport unit
214*b* rotary table
214*c* pouch pressing mechanism
22 pouch takeout unit
22A base frame
22B slide base
22C horizontal drive shaft
22D intermediate frame
22E suction holding member
22F slide driving mechanism
22G first rotational driving mechanism
22H reciprocating driving mechanism
22I second rotational driving mechanism
23 positioning unit (positioning means)
23*a* base plate
23*b* pusher
23*c* pin
23*d* side guide
23*e* stopper
24 pouch transport unit (positioning means)
24D clamper-opener (holding opening means)
24E auxiliary clamper (auxiliary holding means)
31A, 31B parts feeder
32A, 32B conveyance guide
41 conveyor unit
42 clamper
43, 44, 45 seal bar
46 cooling bar
51 conveyance guide rail
52 conveyor means
53 inclining means
54 pusher
61 spout installation head
62 first clamp mechanism (pouch hanging means)
63 positioning-gripping mechanism
636 positioning member
637 positioning grip member
64 second clamp mechanism
65 conveyor unit
P pouch
PC pouch cassette
SA inlet spout
SB outlet spout
SPm spout-attached intermediate pouch

BEST MODE FOR CARRYING OUT THE INVENTION

Figure 34A:
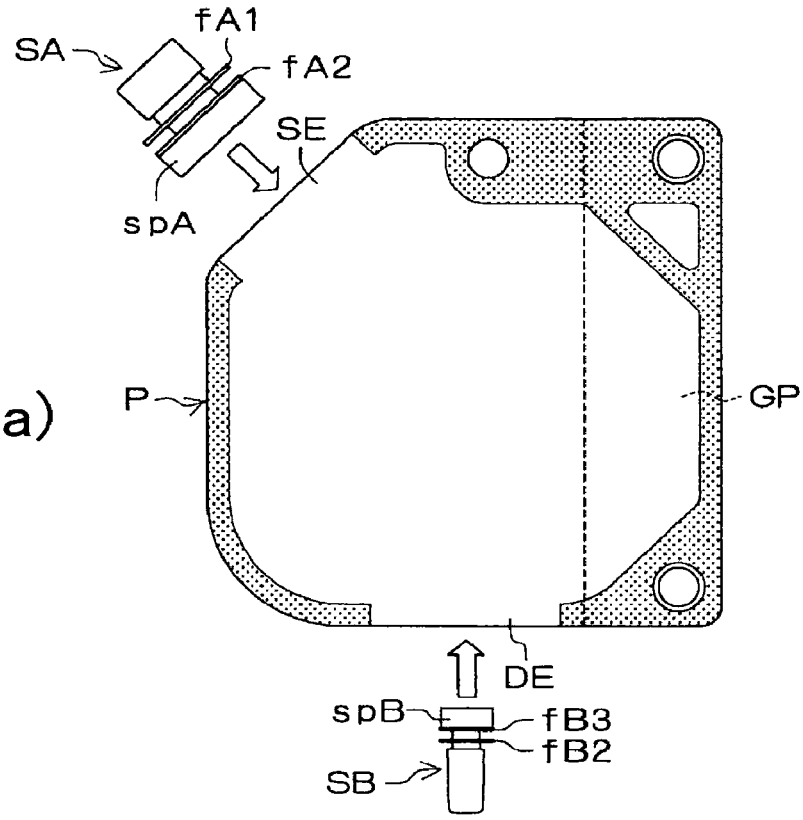
FIG. 34(*a*) is a plan view illustrating a pouch, an inlet spout, and an outlet spout that can be used in the spout installation device illustrated in FIG. 1.
Figure 34B:
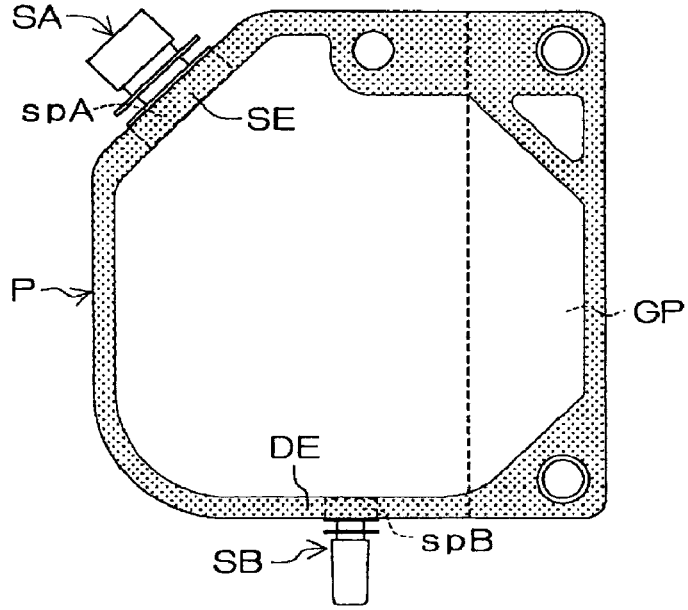
Figure 35:
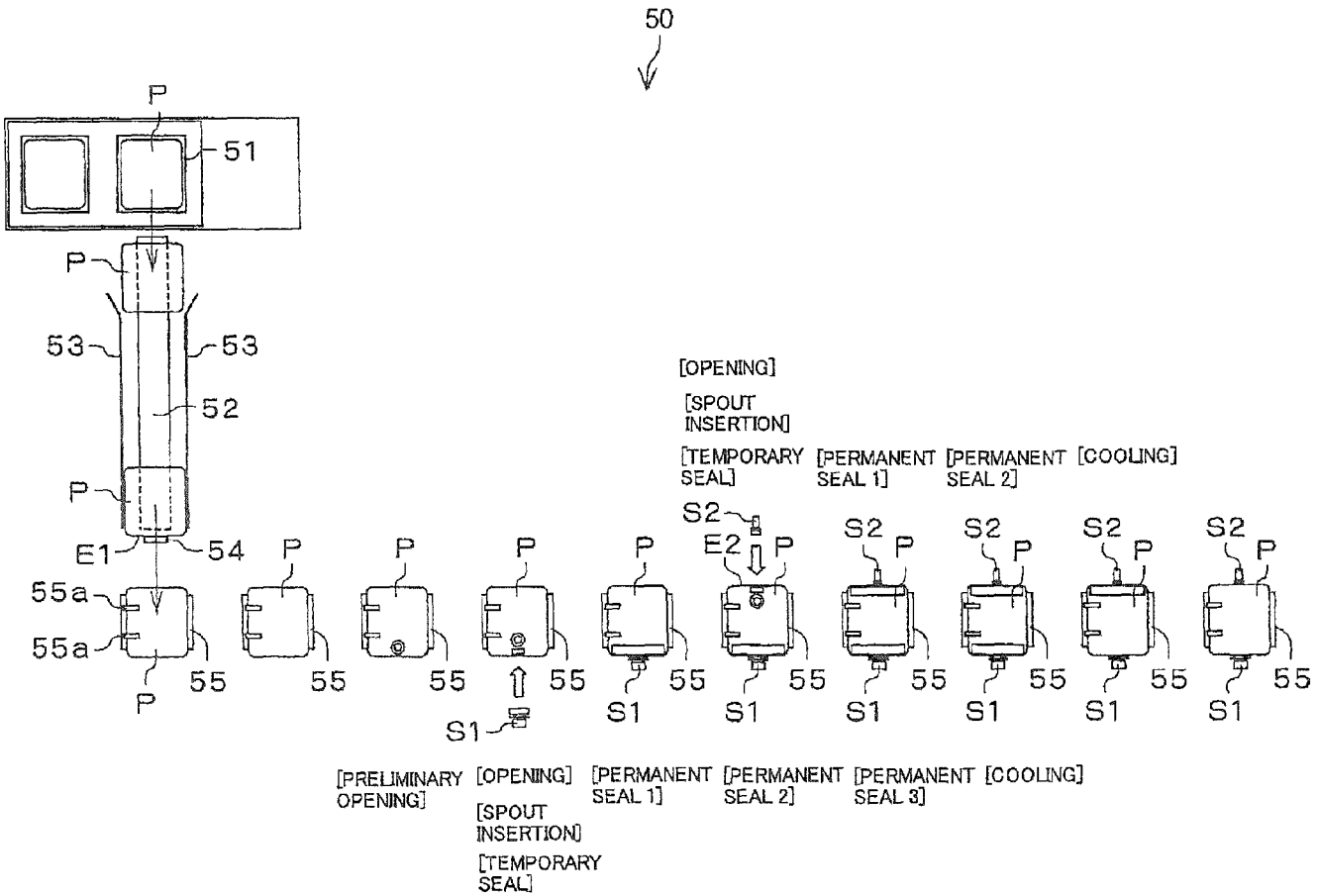
FIG. 35 PRIOR ART
FIG. 35 is a plan view schematically illustrating a conventional spout installation device.
Figure 36A:
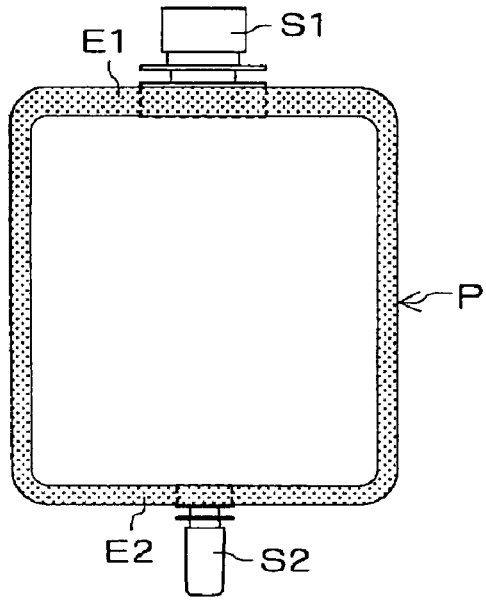
FIG. 36(*a*) is a plan view illustrating a pouch and a spout that can be used in the conventional spout installation device.
Figure 36B:
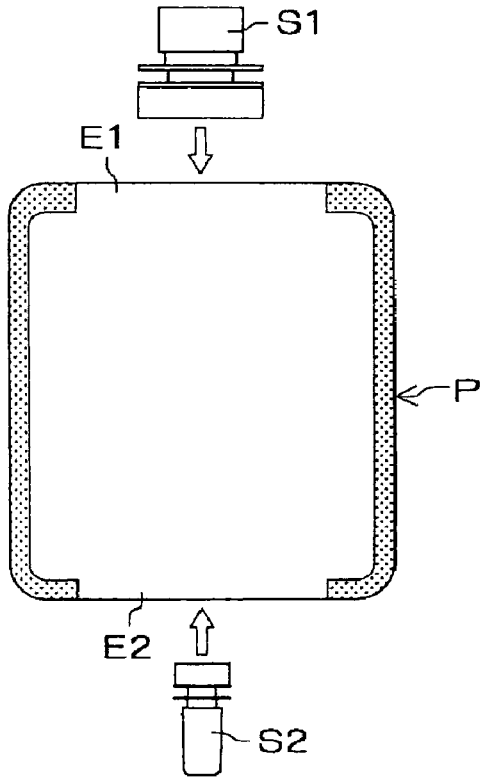

An embodiment of the present invention is described below with reference to the drawings. As illustrated in FIG. 1, a spout installation device 1 performs an operation for installing an inlet spout SA and an outlet spout SB onto a pouch P by sandwiching and heat sealing an installation portion spA of the inlet spout SA and an installation portion spB of the outlet spout SB between non-sealed flexible sheets (e.g., synthetic resin films) constituting an upper inclined edge SE and a lower edge DE of the pouch P that has a gusset portion GP at one side thereof, as illustrated in FIGS. 34(*a*) and 34(*b*). The spout installation device 1 includes a pair of pouch supply sections 2 and 2 that respectively supply the pouches P to pouch supply positions β1 and β2. The spout installation device 1 further includes a first spout supply section 3A that supplies the inlet spouts SA to spout supply positions γ1 and γ2, respectively. The spout installation device 1 further includes a second spout supply section 3B that supplies the outlet spouts SB to spout supply positions δ1 and δ2, respectively. The spout installation device 1 further includes a first spout installation section 4 that installs the inlet spout SA supplied by the first spout supply section 3A to the upper inclined edge SE of the pouch P supplied by the pouch supply section 2. The spout installation device 1 further includes a second spout installation section 6 that installs the outlet spout SB supplied by the second spout supply section 3B at the lower edge DE of the pouch P after the inlet spout SA is installed by the first spout installation section 4. The spout installation device 1 further includes a pair of transfer sections 5 and 5 that transfers the pouch P on which the inlet spout SA are installed (hereinafter, referred to as a spout-attached intermediate pouch SPm) from the first spout installation section 4 to the second spout installation section 6. The spout installation device 1 further includes a pair of delivery sections 7 and 7 that delivers a spout-attached pouch container SP, which is the pouch P on which both the inlet spout SA and the outlet spout SB are installed, from the second spout installation section 6. In FIGS. 34(*a*) and 34(*b*), a portion indicated by half-tone dot meshing is a heat sealed portion.

As illustrated in FIG. 1, the above-described pouch supply section 2 includes a pouch stocker 21 that stocks pouch cassettes PC that can store numerous pouches P in an upright state and successively transports the stocked pouch cassettes PC to a pouch takeout position α1 (α2). The pouch supply section 2 further includes a pouch takeout unit 22 that successively takes the pouch P out of the pouch cassette PC having been transported to the pouch takeout position α1 (α2). The pouch supply section 2 further includes a positioning unit 23 that positions the pouch P taken out by the pouch takeout unit 22. The pouch supply section 2 further includes a pouch transport unit (not illustrated) that transports the pouch P positioned in a state where the upper inclined edge SE is opened to a pouch supply position β1 (β2). The pouch P having been transported to the pouch supply position β1 (β2) is in a state where the opened upper inclined edge SE is coupled with the installation portion spA of the inlet spout SA.

Figure 2:
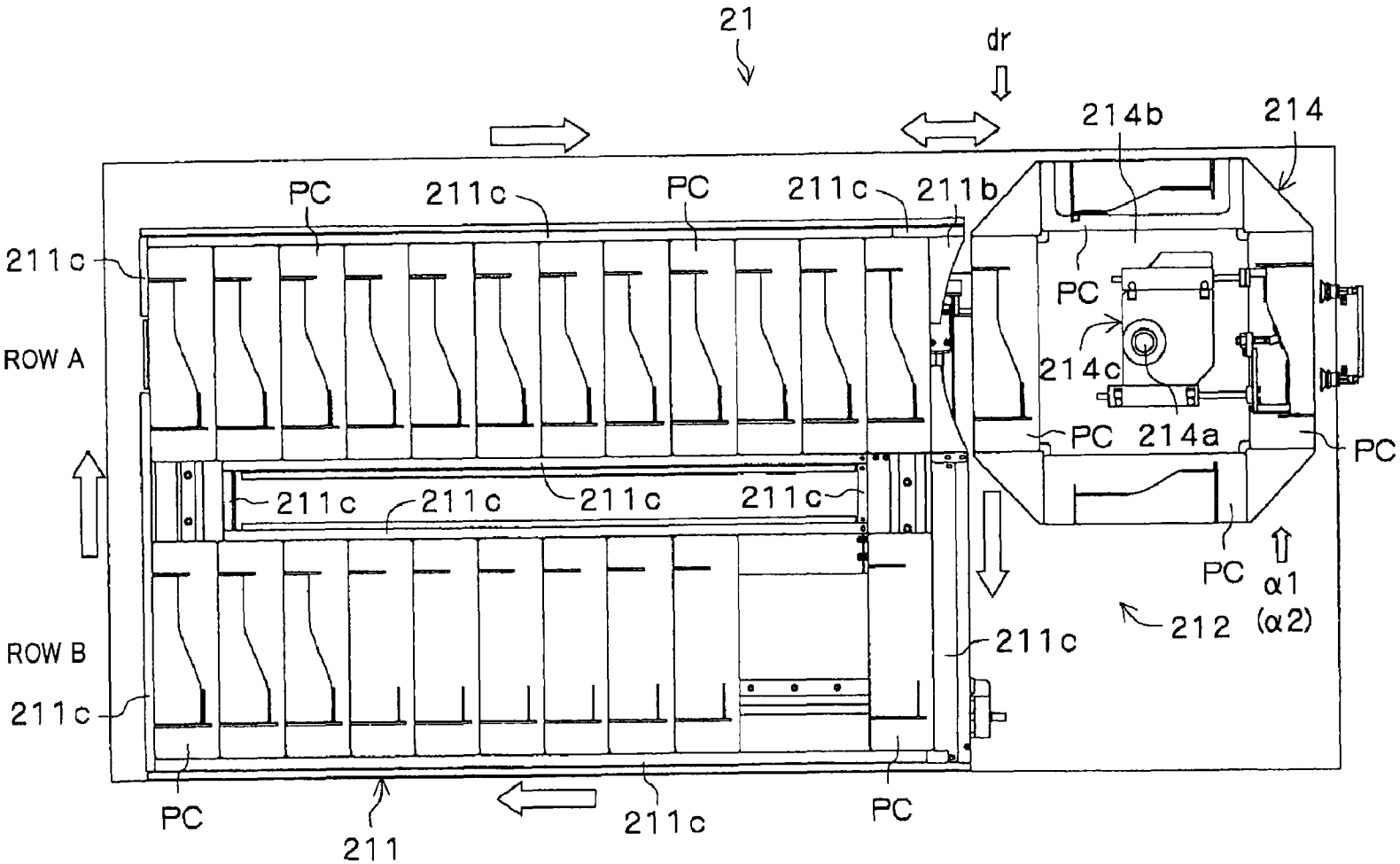
FIG. 2 is a plan view illustrating a pouch stocker mounted on the spout installation device illustrated in FIG. 1.

The above-described pouch stocker 21, as illustrated in FIG. 2, includes a cassette mounting base 211 that can mount numerous pouch cassettes PC in a 2-row arrangement consisting of a row A and a row B and a cassette transport mechanism 212 that can successively transport the pouch cassettes PC mounted on the cassette mounting base 211 to the pouch takeout position al (α2). If all of the pouches P are taken out of a pouch cassette PC at the pouch takeout position α1 (α2), the pouch stocker 21 can move the empty pouch cassette PC from the row A to the row B. Therefore, after the empty pouch cassette PC is transferred to the row B, the pouch cassette PC can be filled with new pouches P.

Figures 3A, 3B, 3C, 3D, 3E:
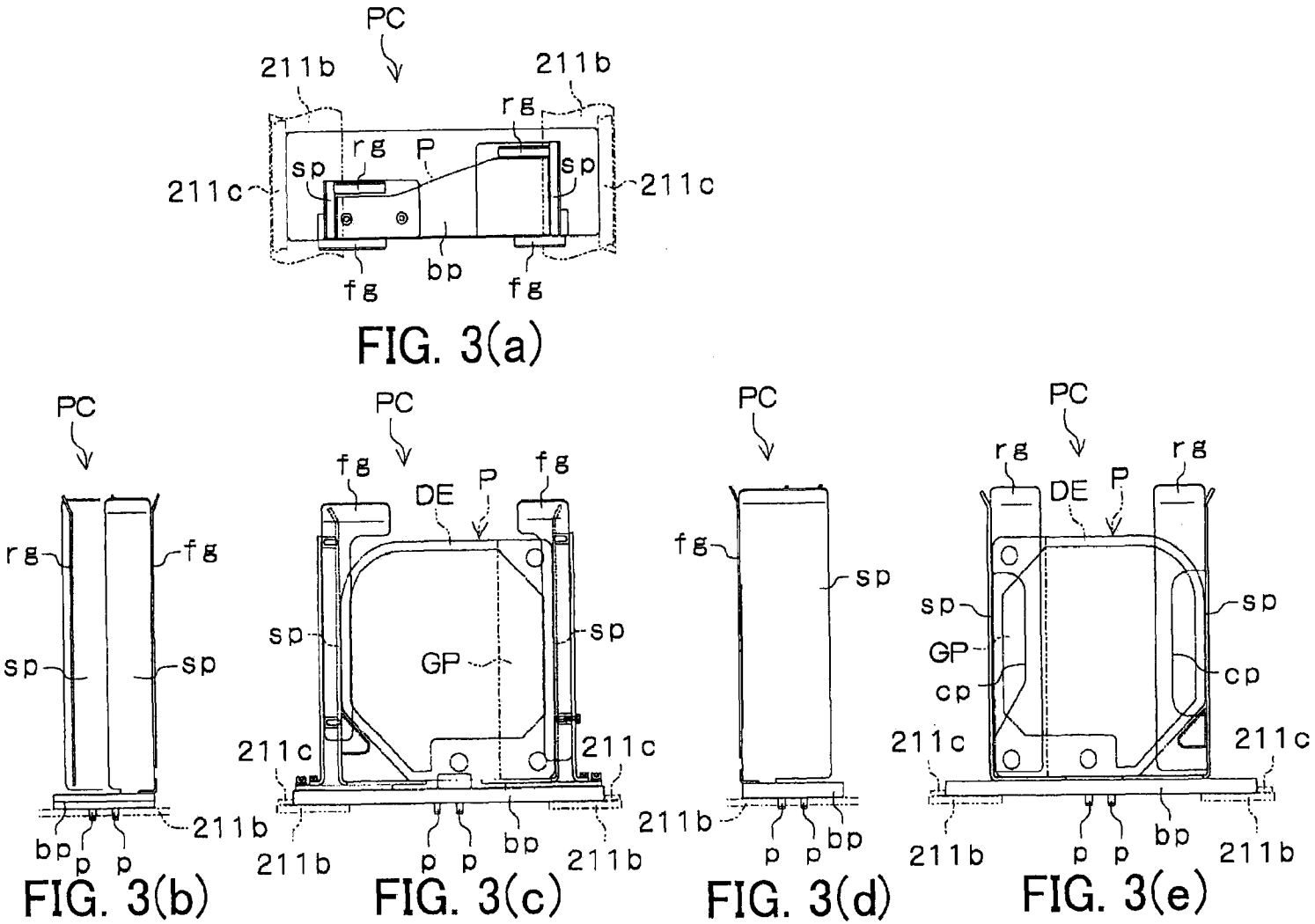
FIG. 3(*a*) is a plan view illustrating a pouch cassette that can be used for the pouch stocker illustrated in FIG. 2.

The above-described pouch cassette PC, as illustrated in FIGS. 3(*a*) to 3(*e*), includes a synthetic resin made bottom plate bp, metallic side plates sp and sp that respectively extend upward from the bottom plate bp, metallic front guide plates fg and fg and metallic rear guide plates rg and rg that are respectively fixed to the side plates sp and sp, and four pins p that protrude downward from a lower surface of the bottom plate bp. The lower edge DE, onto which the outlet spout SB can be installed, faces upward in a state where the pouch P is accommodated in an upright state.

When upright pouches P are assembled together with their lower edges DE facing upward, a thickness of the gusset portion GP portion becomes larger than a thickness of the other portion. Therefore, a width of one side plate sp positioned on the gusset portion GP side of the pouch P is set to be larger than a width of the other side plate sp. Further, one rear guide plate rg positioned on the gusset portion GP side is located at a rear side compared to the other rear guide plate rg. Accordingly, even when the pouch P accommodated in the pouch cassette PC is a gusset type whose thickness is party different, the accommodation state of the pouch P does not collapse and therefore the accommodation state can be maintained stably.

A cutout portion cp is formed on each of the rear guide plates rg and rg at a side plate sp side at which each rear guide plate rg is fixed, so that both side portions of a pouch assembly accommodated in the pouch cassette PC can protrude partly. Thus, the both side portions of the pouch assembly accommodated in the pouch cassette PC can be pressed from the rear side.

Figure 4:
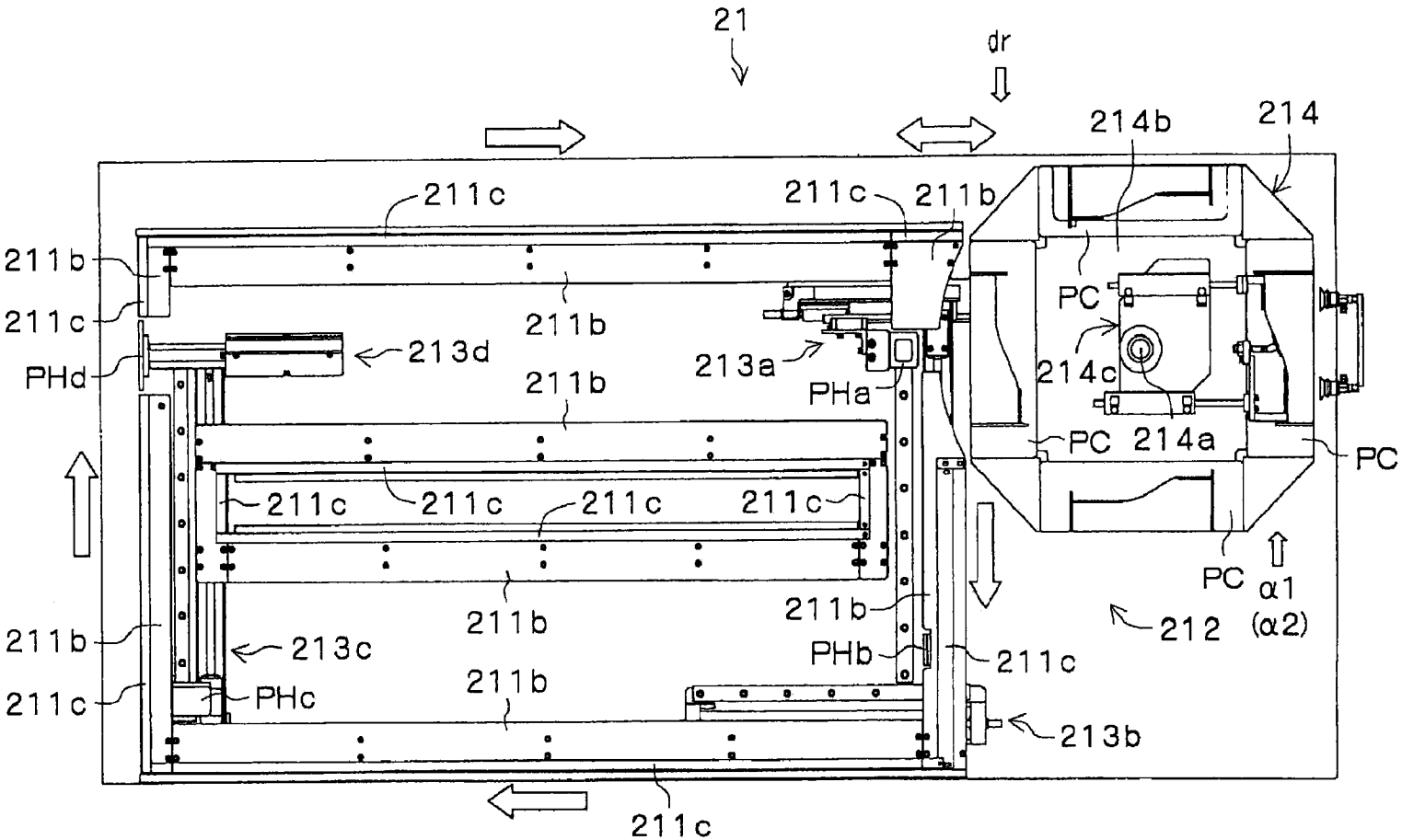
FIG. 4 is a plan view illustrating a state where pouch cassettes are removed from the pouch stocker illustrated in FIG. 2.
Figure 5:
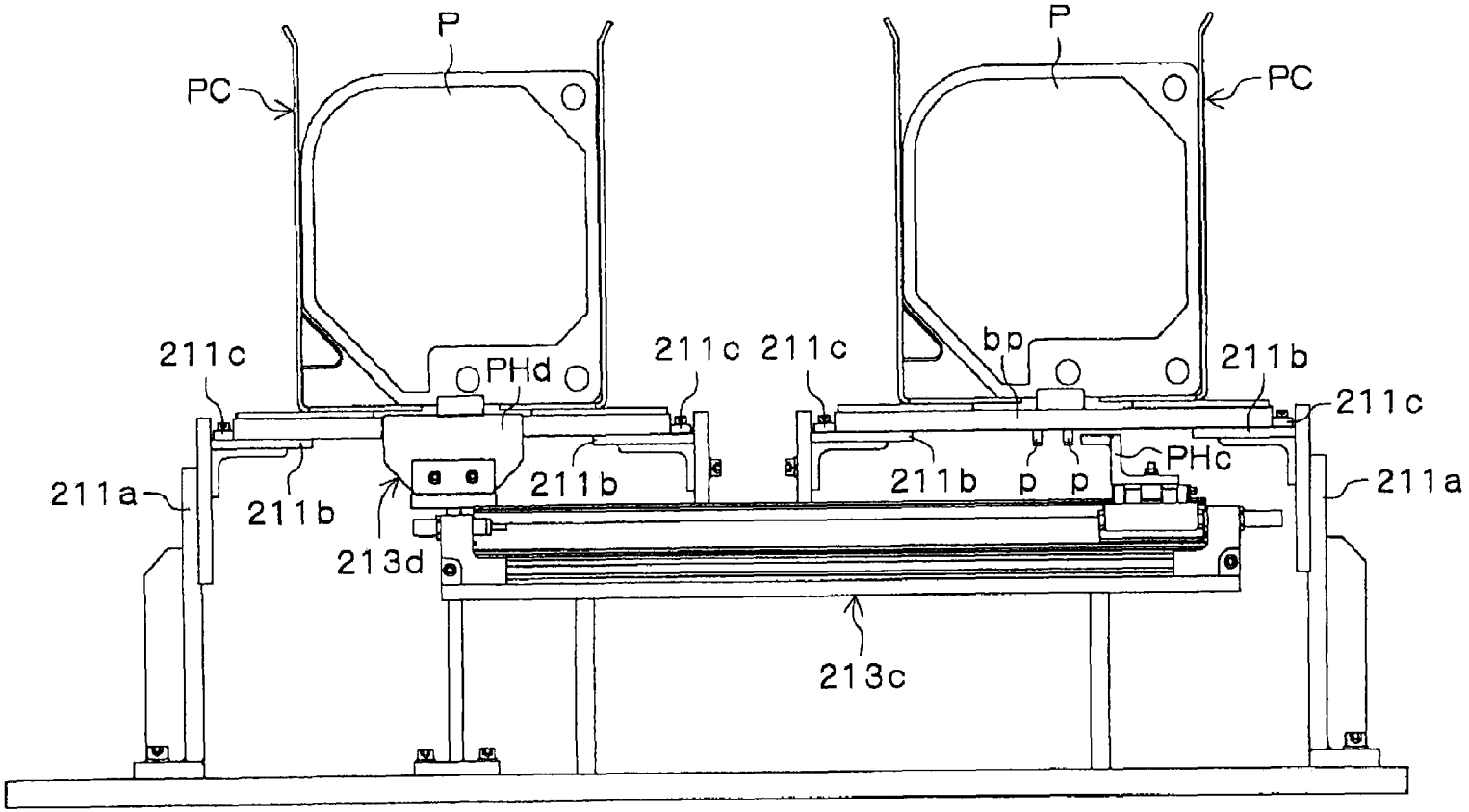
FIG. 5 is a rear view illustrating the pouch stocker illustrated in FIG. 2.
Figure 6:
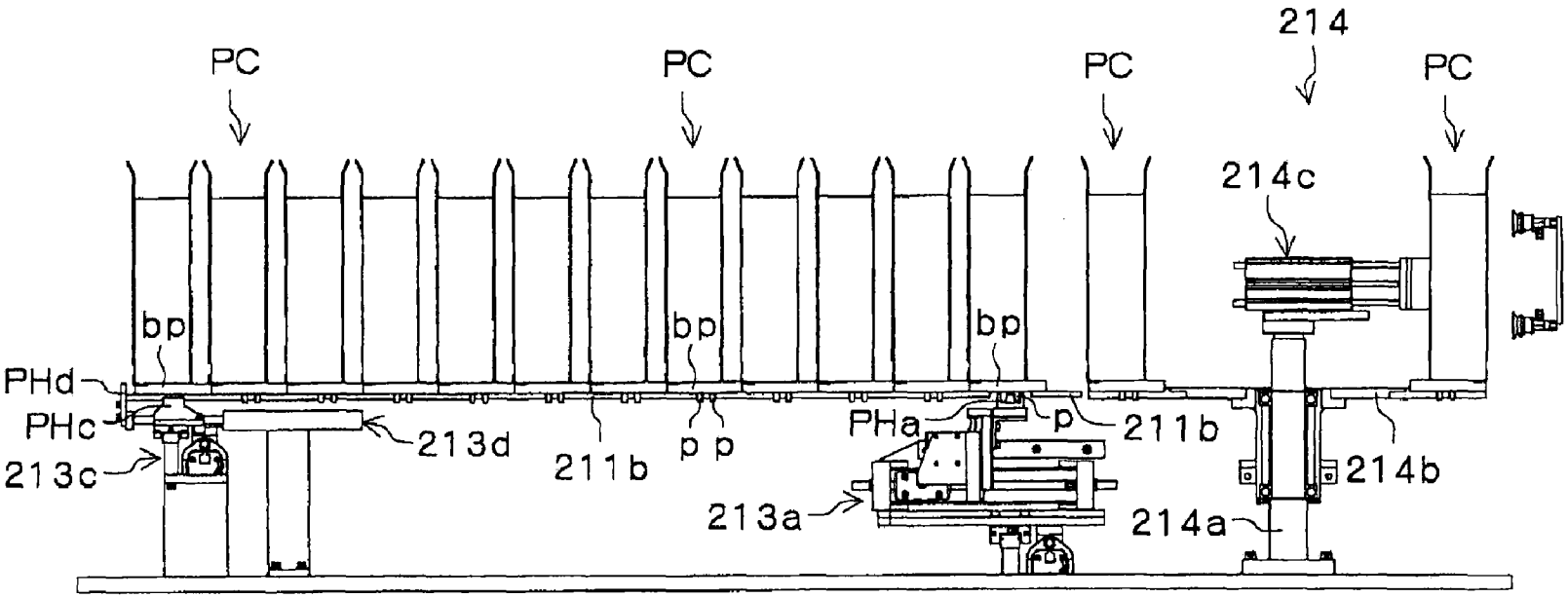
FIG. 6 is a side view illustrating the pouch stocker illustrated in FIG. 2.

The above-described cassette mounting base 211, as illustrated in FIGS. 4 to 6, includes a pedestal 211*a* placed on a floor, a plurality of base plates 211*b* attached to the pedestal 211*a* and mounting the pouch cassettes PC, and guide plates 211*c* that can guide the pouch cassettes PC mounted on the base plates 211*b* along their conveyance path. Therefore, respective pouch cassettes PC can slide on the base plates 211*b* along their conveyance path.

The above-described cassette transport mechanism 212, as illustrated in FIGS. 4 to 6, includes three pushers 213*a*, 213*b*, and 213*c* made of rodless cylinders that respectively carry the pouch cassettes PC mounted on the base plates 211*b* of the cassette mounting base 211 in predetermined directions, a pusher 213*d* made of a normal cylinder, and a rotary type transport unit 214. The pusher 213*a* transports a pouch cassette PC between the right side of the row A and the transport unit 214 and further transports a pouch cassette PC positioned on the right side of the row A to the right side of the row B. The pusher 213*b* transports a pouch cassettes PC positioned in the row B to the left. The pusher 213*c* transports a pouch cassette PC positioned on the left side of the row B to the left side of the row A. The pusher 213*d* transports a pouch cassettes PC positioned in the row A to the right.

The above-described pusher 213*a* includes a head PHa that can move in the up-and-down direction. When the head PHa moves upward at a lower position of the four pins p of a pouch cassette PC, the head PHa can engage with the four pins p. Then, the head PHa moves horizontally in a predetermined direction to transport the pouch cassette PC in the predetermined direction. On the other hand, the pushers 213*b* to 213*d* include heads PHb to PHd that do not move in the up-and-down direction and can move in the horizontal direction. Each of the heads PHb and PHc of the pushers 213*b* and 213*c* can be brought into contact with two pins P of the four pins p of a pouch cassette PC to push the pouch cassette PC in a predetermined direction. The head PHd of the pusher 213*d* can be brought into contact with an edge of the bottom plate by of a pouch cassette PC to push the pouch cassette PC in a predetermined direction.

The above-described rotary type transport unit 214, as illustrated in FIGS. 4 and 6, includes a rotary table 214*b* that is rotatably supported by a vertically extending support shaft 214*a*, a driving means (not illustrated) for rotating the rotary table 214*b*, and a pouch pressing mechanism 214*c* that is attached to an upper end portion of the support shaft 214*a* and can press a rear side of a pouch assembly placed in the pouch cassette PC positioned at the pouch takeout position α1 (α2). A pouch cassette PC can be transferred from the cassette mounting base 211 to the rotary table 214*b* at a cassette transfer position dr. Then, the pouch cassette PC can be transported to the pouch takeout position α1 (α2) when the rotary table 214*b* rotates around the support shaft 214*a*.

Figure 7:
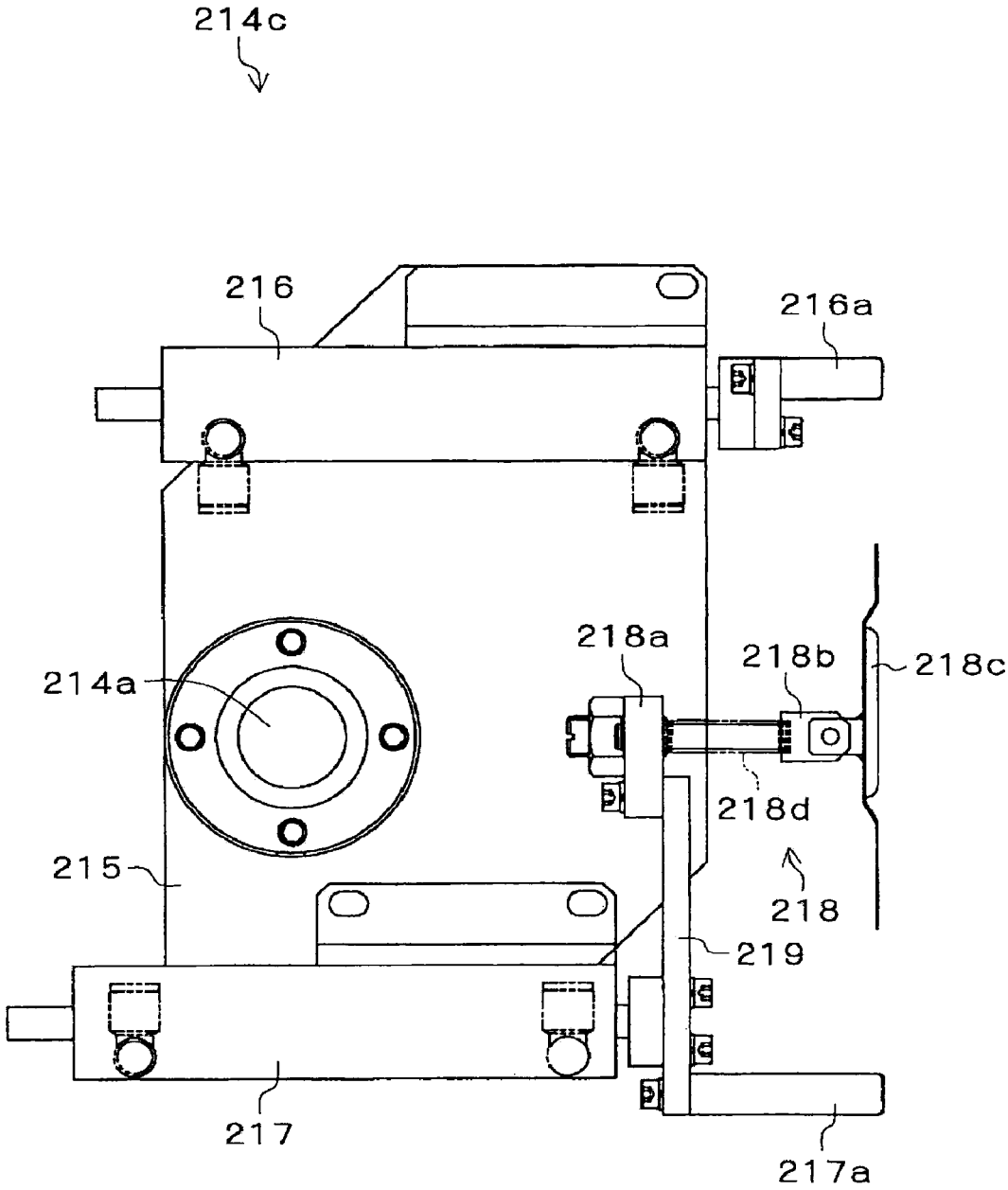
FIG. 7 is a plan view illustrating a pouch pressing mechanism that constitutes a transport unit mounted on the pouch stocker illustrated in FIG. 2.

The above-described pouch pressing mechanism 214*c*, as illustrated in FIG. 7, includes a first pressing mechanism 216 and a second pressing mechanism 217 that are air cylinders capable of pressing both sides of a pouch assembly placed in the pouch cassette PC, and further includes a third pressing mechanism 218 that can press a central portion of the pouch assembly placed in the pouch cassette PC in the width direction. The first pressing mechanism 216 and the second pressing mechanism 217 are attached to a base plate 215 that is fixed to the support shaft 214*a*.

The above-described first pressing mechanism 216 includes a pressing head 216*a* attached to a distal end of a piston rod and protruding in a pressing direction. The above-described second pressing mechanism 217 includes a pressing head 217*a* attached to a distal end of a piston rod and protruding in a pressing direction. The pressing heads 216*a* and 217*a* can enter the cutout portions cp formed on the rear guide plates rg and rg of the pouch cassette PC and can press the both sides of the pouch assembly placed in the pouch cassette PC.

The above-described third pressing mechanism 218 includes a base member 218*a* attached via a connecting arm 219 to the piston rod of the air cylinder that constitutes the second pressing mechanism 217. The third pressing mechanism 218 further includes an intermediate member 218*b* that is supported by the base member 218*a* and is movable relative to the base member 218*a*. The third pressing mechanism 218 further includes a pressing head 218*c* that is supported in a freely swingable state by a distal end portion of the intermediate member 218*b*. A spring 218*d* resiliently urges the intermediate member 218*b* in the pressing direction.

When the pressing heads 216*a* and 217*a* of the first pressing mechanism 216 and the second pressing mechanism 217 press the pouch assembly placed in the pouch cassette PC, an air supply source can supply air into one cylinder chamber (pressing chamber) of each air cylinder so that the cylinder chamber can be constantly held at a predetermined pressure. Thus, a predetermined pressing force is constantly applied to the both sides of the pouch assembly regardless of the number of pouches P accommodated in the pouch cassette PC or a difference in thickness between both sides.

Further, as described above, the pressing head 218*c* is supported in a freely swingable state by the distal end portion of the intermediate member 218*b*. Therefore, the pressing head 218*c* can press the central portion of a pouch assembly whose thickness varies in the width direction from one side portion to the other side portion while the pressing head 218*c* is kept in an inclined state. Further, the intermediate member 218*b* is resiliently urged by the spring 218*d* in the pressing direction. Therefore, the pressing force does not extremely decrease even when the number of the pouches P accommodated in the pouch cassette PC is small.

Figures 8A, 8B, 8C, 8D, 8E:
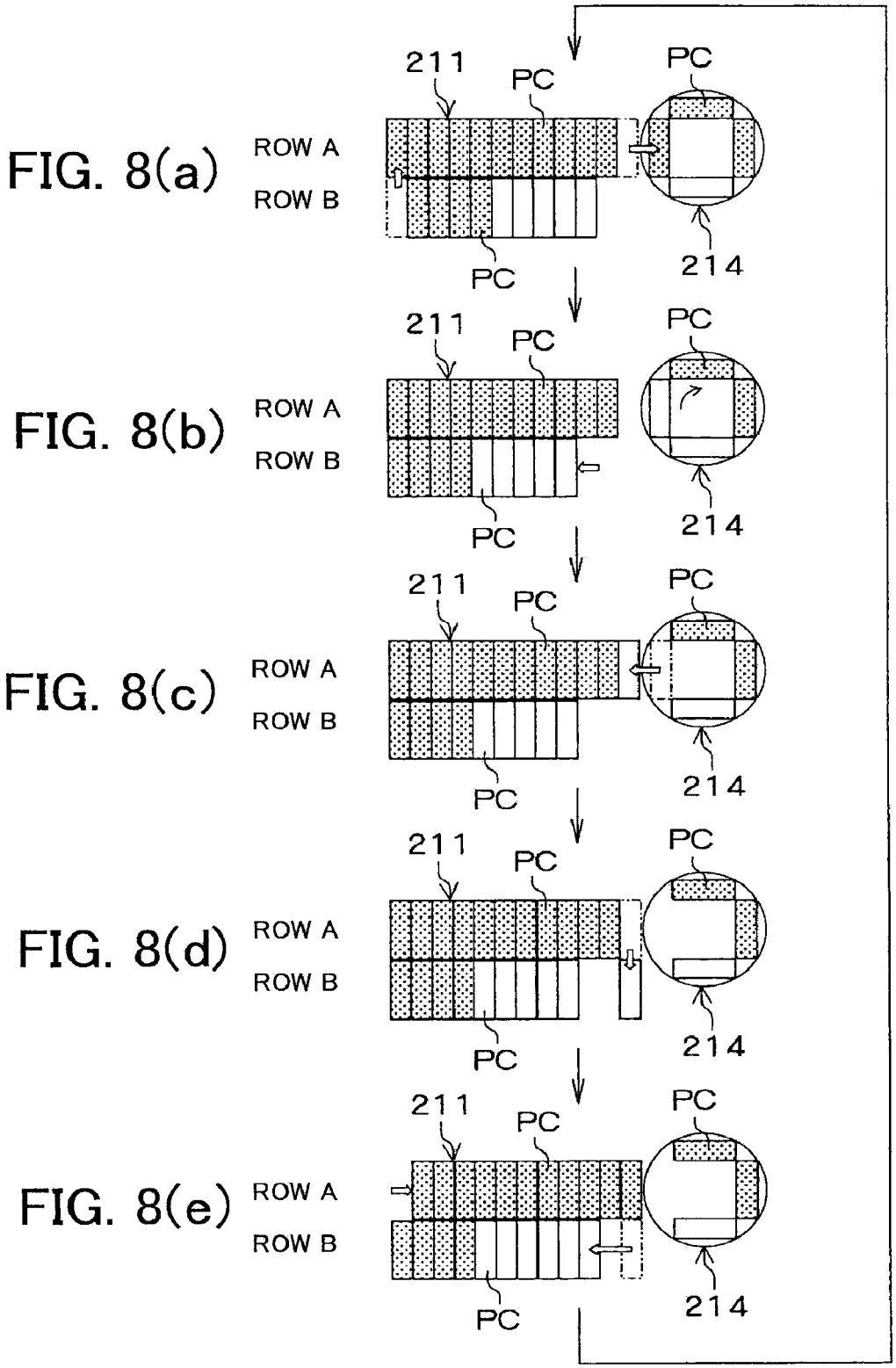
FIGS. 8(*a*)-8(*e*) are an operational view illustrating an operation that can be performed by the pouch stocker illustrated in FIG. 2.

An operation that can be performed by the pouch stocker 21 having the above-described configuration is described below with reference to FIG. 8. First, as illustrated in FIG. 8(*a*), a pouch cassette PC positioned on the right side of the row A of the cassette mounting base 211 is pushed out to the rotary table 214*b* of the transport unit 214 from a state illustrated in FIG. 8(*e*). Meanwhile, a pouch cassette PC positioned on the left side of the row B of the cassette mounting base 211 is pushed out to the left side of the row A.

Subsequently, as illustrated in FIG. 8(*b*), the rotary table 214*b* of the transport unit 214 rotates 90 degrees while the pouch cassettes PC in the row B are respectively moved left. Then, as illustrated in FIG. 8(*c*), an empty pouch cassette PC is transferred from the rotary table 214*b* of the transport unit 214 to the right side of the row A of the cassette mounting base 211.

Subsequently, as illustrated in FIG. 8(*d*), the empty pouch cassette PC is transferred from the right side of the row A of the cassette mounting base 211 to the right side of the row B. Then, as illustrated in FIG. 8(*e*), the pouch cassettes PC in the row A are respectively moved right, while a pouch cassette PC on the right side of the row B is moved left. The above-described operation is repetitively performed.

Figure 9:
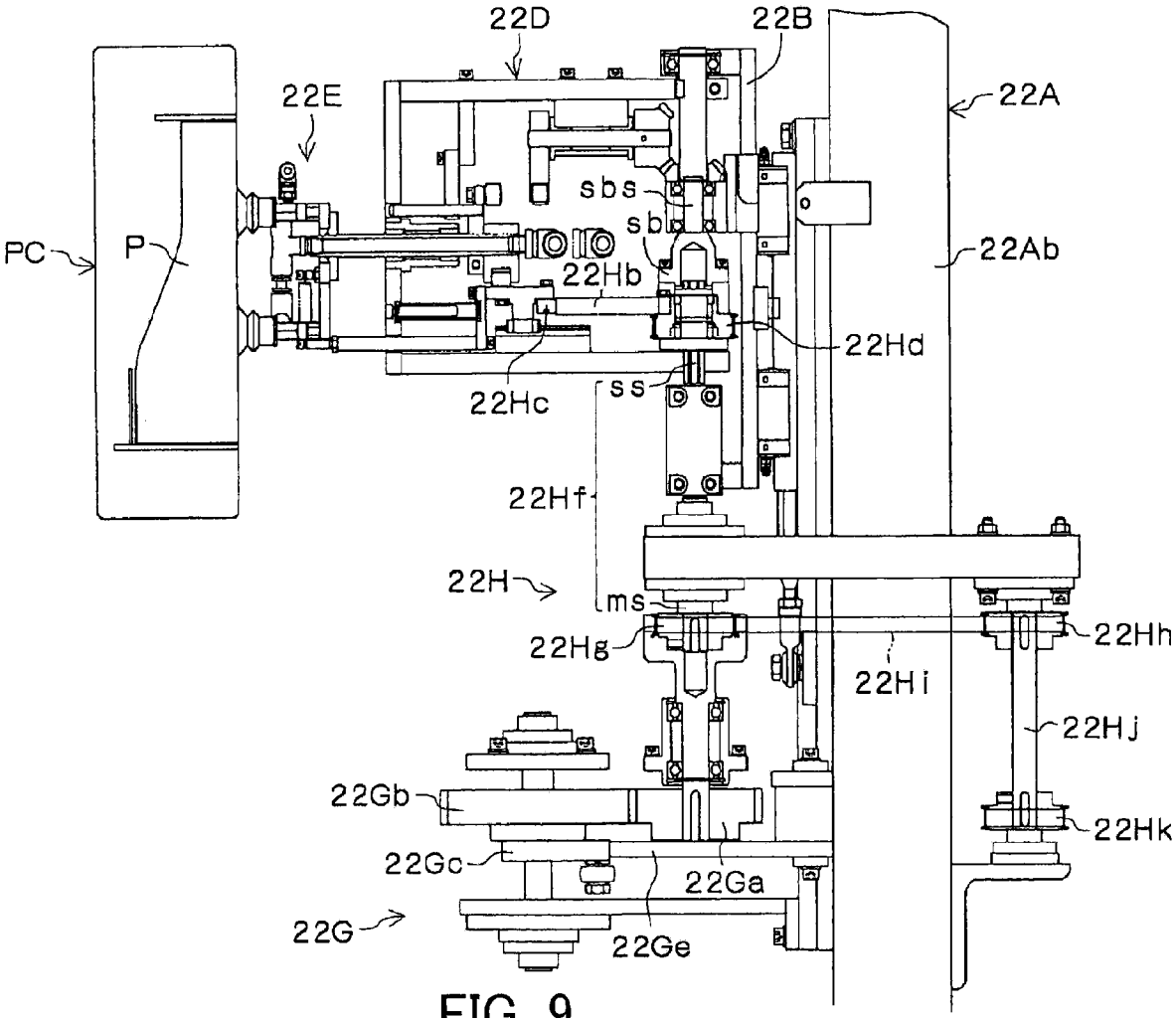
FIG. 9 is a plan view illustrating a pouch takeout unit mounted on the spout installation device illustrated in FIG. 1.
Figure 10:
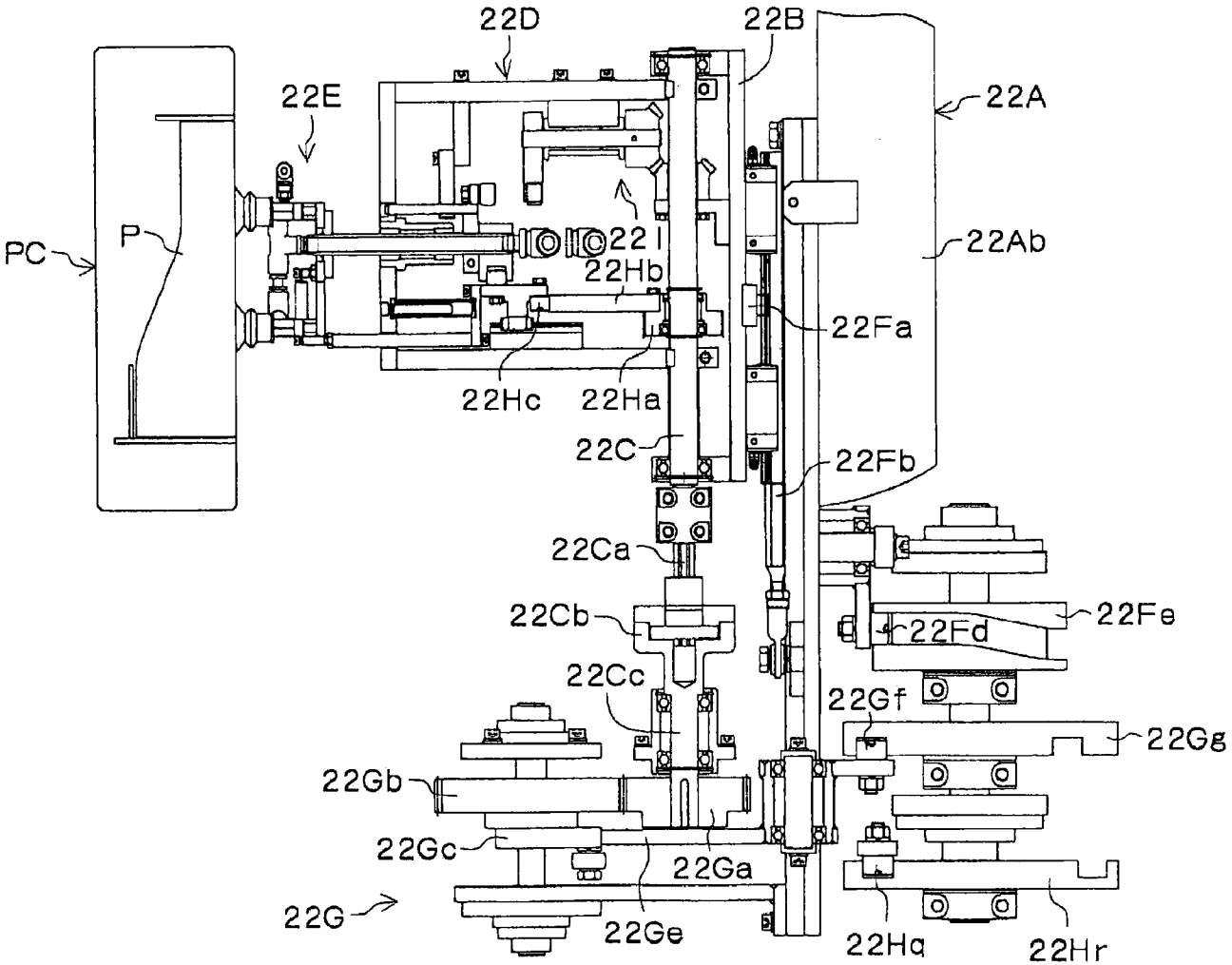
FIG. 10 is a plan view illustrating the pouch takeout unit illustrated in FIG. 9.
Figure 11:
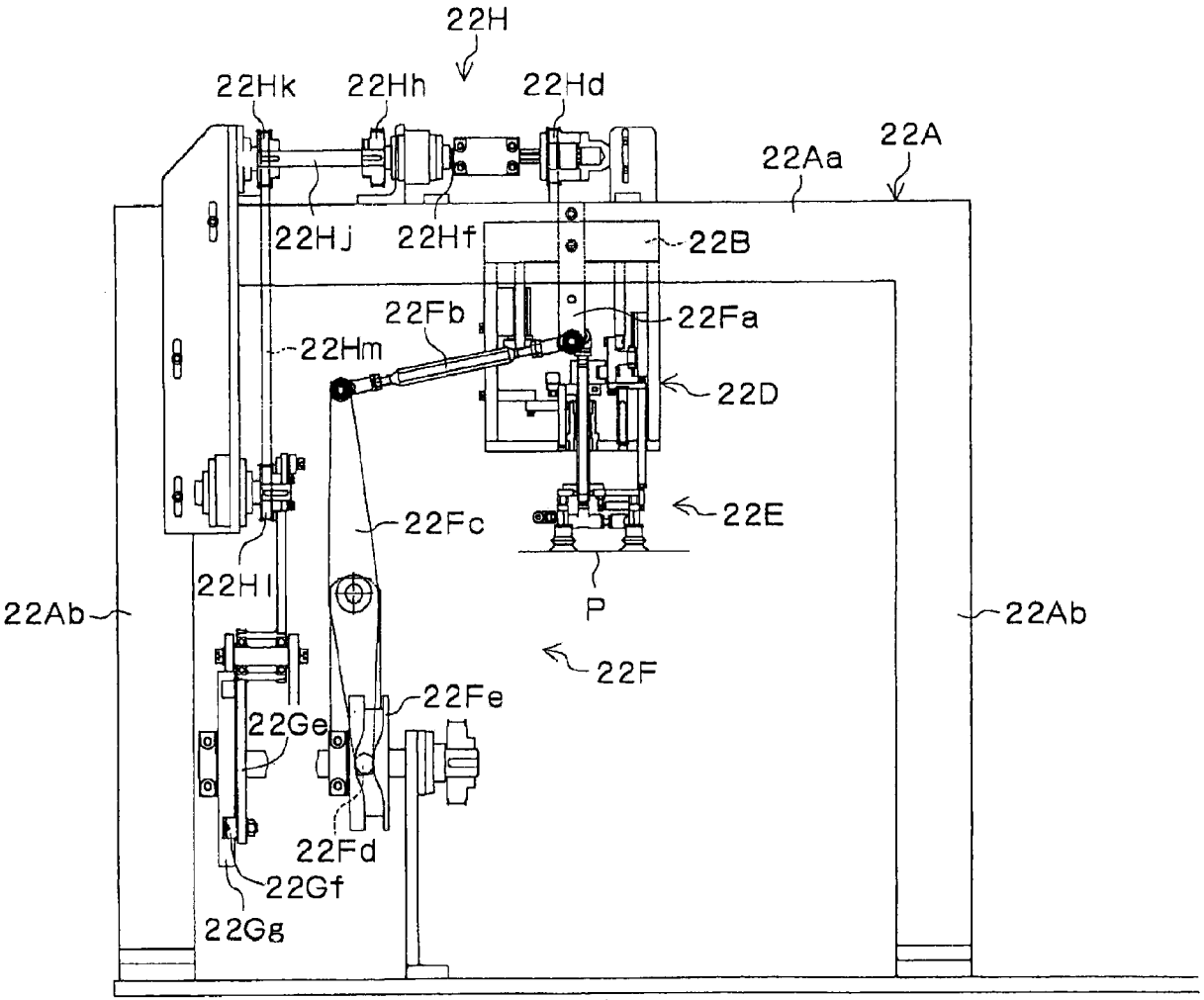
FIG. 11 is a front view illustrating the pouch takeout unit illustrated in FIG. 9.

The above-described pouch takeout unit 22, as illustrated in FIGS. 9 to 11, includes a gate-type base frame 22A that is placed in an upright state so as to face the pouch takeout position $\alpha$1 ($\alpha$2). The pouch takeout unit 22 includes a pair of vertical frames 22Aa whose upper end portions are connected via a lateral frame 22Ab. The pouch takeout unit 22 further includes a slide base 22B supported by the lateral frame 22Ab of the base frame 22A so as to be slidable in a longitudinal direction thereof (i.e., the width direction of the base frame 22A), and a horizontal drive shaft 22C that is rotatably supported by the slide base 22B and extends in the longitudinal direction of the lateral frame. The pouch takeout unit 22 further includes a U-shaped intermediate frame 22D that includes a proximal end portion fixed to the horizontal drive shaft 22C so that a distal end side protrudes in a direction perpendicular to an axial center of the horizontal drive shaft 22C. The intermediate frame 22D includes a pair of side plates 22Da having distal end portions mutually connected via a connection plate 22Db. The pouch takeout unit 22 further includes a suction holding member 22E that is supported by the intermediate frame 22D so that the suction holding member 22E can move in its protruding direction. The pouch takeout unit 22 further includes a slide driving mechanism 22F that can cause the slide base 22B to slide. The pouch takeout unit 22 further includes a first rotational driving mechanism 22G that can rotate the intermediate frame 22D by 90 degrees about the horizontal drive shaft. The pouch takeout unit 22 further includes a reciprocating driving mechanism 22H that can move the suction holding member 22E in the protruding direction of the intermediate frame 22D. The pouch takeout unit 22 further includes a second rotational driving mechanism 22I that can rotate the suction holding member 22E about the axial center extending in the reciprocating direction.

Figure 17B:
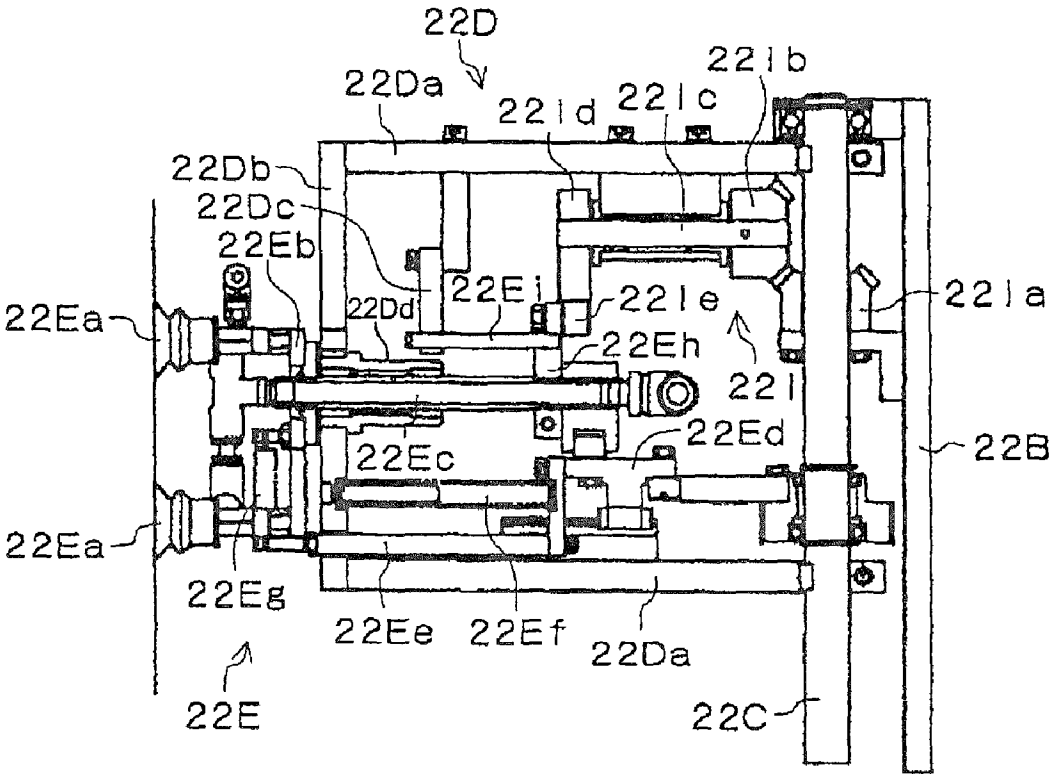
FIG. 17(*a*) is a schematic view illustrating a suction holding member that constitutes the pouch takeout unit illustrated in FIG. 9, which can be seen from a suction head side.
Figure 17A:
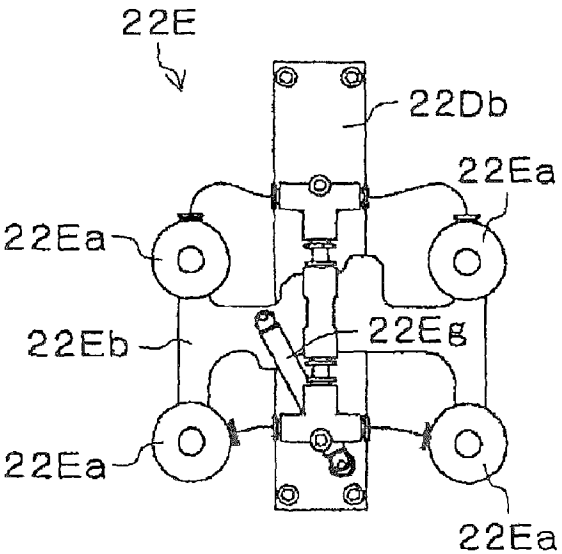

The above-described suction holding member 22E, as illustrated in FIGS. 17(*a*) and 17(*b*), includes four suction heads 22Ea and a support plate 22Eb that supports these suction heads 22Ea. The suction holding member 22E further includes a suction pipe 22Ec that is connected to the suction heads 22Ea and fixed to the support plate 22Eb. The suction pipe 22Ec is supported, via a bearing 22Dd, by the connection frame 22Db of the intermediate frame 22D so as to be rotatable and movable in the reciprocating direction. The suction holding member 22E further includes a slide base 22Ed that is slidably supported by one side plate 22Da of the intermediate frame 22D. The suction holding member 22E further includes a guide bar 22Ee that has one end side fixed to the slide base 22Ed and the other end side inserted in the connection frame 22Db of the intermediate frame 22D. The suction holding member 22E further includes a spring 22Ef that is disposed between the connection frame 22Db of the intermediate frame 22D and the slide base 22Ed and can resiliently urge the slide base 22Ed toward the proximal end portion side of the intermediate frame 22D. The suction holding member 22E further includes a spring 22Eg that has one end connected to a distal end portion of the guide bar 22Ee and the other end connected to the support plate 22Eb. The spring 22Eg can resiliently urge the support plate 22Eb, which can rotate about the suction pipe 22Ec, in a counterclockwise direction when seen from the suction head 22Ea side. The suction holding member 22E further includes a detent member 22Ei that is fixed to a lever 22Eb having one end side that can be inserted in the connection frame 22Db of the intermediate frame 22D and the other end side attached to the suction pipe 22Ec. The detent member 22Ei can abut a stopper member 22Dc attached to the other side plate 22Da of the intermediate frame 22D. Thus, the detent member 22Ei can prevent the suction pipe 22Ec from rotating.

Figure 16A:
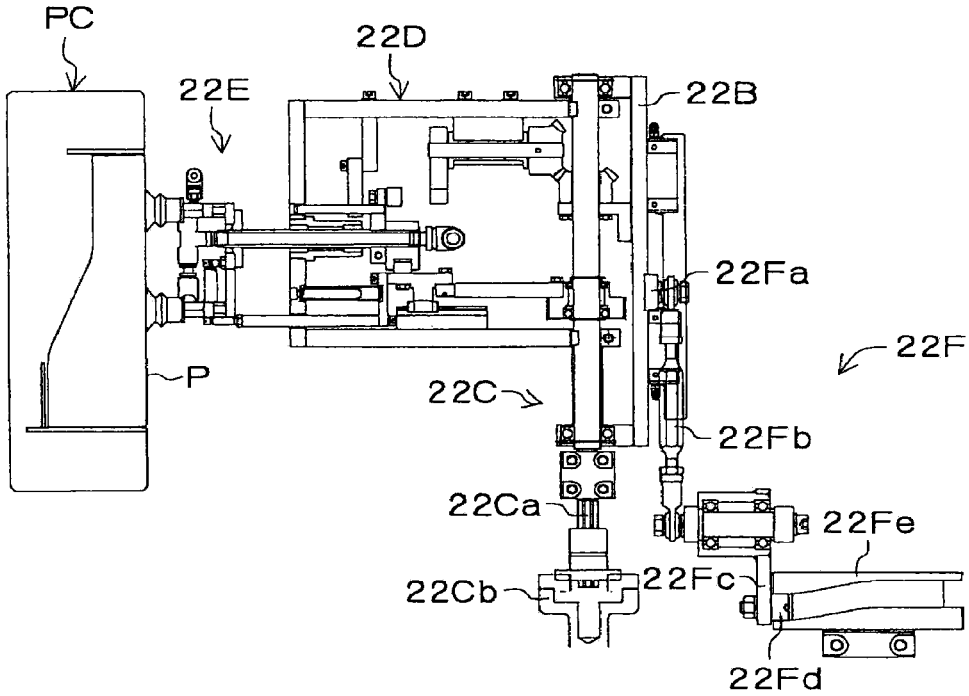
FIGS. 16(*a*) and 16(*b*) are side views illustrating a slide driving mechanism that constitutes the pouch takeout unit illustrated in FIG. 9.
Figure 16B:
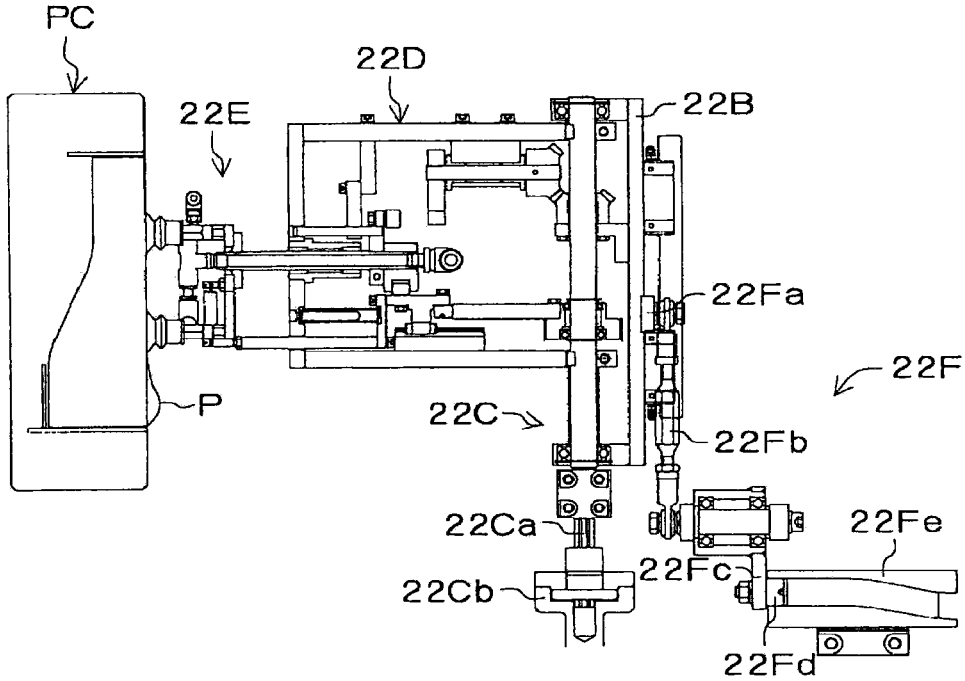

The above-described slide driving mechanism 22F, as illustrated in FIG. 11 and FIGS. 16(*a*) and 16(*b*), includes a connection member 22Fa attached to the slide base 22B, a rod 22Fb having one end connected to a lower end portion of the connection member 22Fa by means of a pin, and a swing arm 22Fc supported at its central portion in the longitudinal direction so as to be swingable and having one end connected to the other end of the rod 22Fb by means of a pin. The slide driving mechanism 22F further includes a cam mechanism for causing the swing arm 22Fc to swing. The cam mechanism includes a cam follower 22Fd attached to the other end of the swing arm 22Fc and a drum cam 22Fe having a cam groove formed on its outer cylindrical surface with which the cam follower 22Fd can engage. When the swing arm 22Fc swings, the slide base 22B can slide. When the slide base 22B slides, the horizontal drive shaft 22C supported by the slide base 22B can move in the axial direction. Therefore, to absorb a movement of the horizontal drive shaft 22C in the axial direction, a spline shaft 22Ca is connected to one end portion of the horizontal drive shaft 22C. The spline shaft 22Ca is supported by a spline bearing 22Cb. An axial portion 22Cc connected to the spline bearing 22Cb is supported so as to be rotatable (see FIG. 10).

The above-described first rotational driving mechanism 22G, as illustrated in FIGS. 10, 11, 14, and 15, includes a gear 22Ga attached to the axial portion 22Cc of the fixing side spline bearing 22Cb, a gear 22Gb supported to be rotatable in a state where the gear 22Gb is meshed with the gear 22Ga, a lever 22Gc fixed to a rotational shaft of the gear 22Gb, and a rod 22Gd having one end connected to the lever 22Ge by means of a pin. The first rotational driving mechanism 22G further includes a swing arm 22Ge supported at its central portion in the longitudinal direction so as to be swingable and having one end connected to the other end of the rod 22Gd by means of a pin. The first rotational driving mechanism 22G further includes a cam mechanism for causing the swing arm 22Ge to swing. The cam mechanism includes a cam follower 22Gf attached to the other end of the swing arm 22Ge and a cam plate 22Gg having a cam groove formed on one surface with which the cam follower 22Gf can engage. When a driving means (not illustrated) rotates the cam plate 22Gg, the gear 22Gb can alternately rotate 90 degrees in opposite directions. The gear 22Gg rotates 90 degrees in a direction opposed to the rotational direction of the gear 22Gb. Therefore, the first rotational driving mechanism 22G alternately repeats an inclining operation for inclining the intermediate frame 22D that supports the suction holding member 22E from a horizontal state illustrated in FIG. 14 to a vertical state illustrated in FIG. 15 and a returning operation for returning the intermediate frame 22D from the vertical state illustrated in FIG. 15 to the horizontal state illustrated in FIG. 14.

Figure 12:
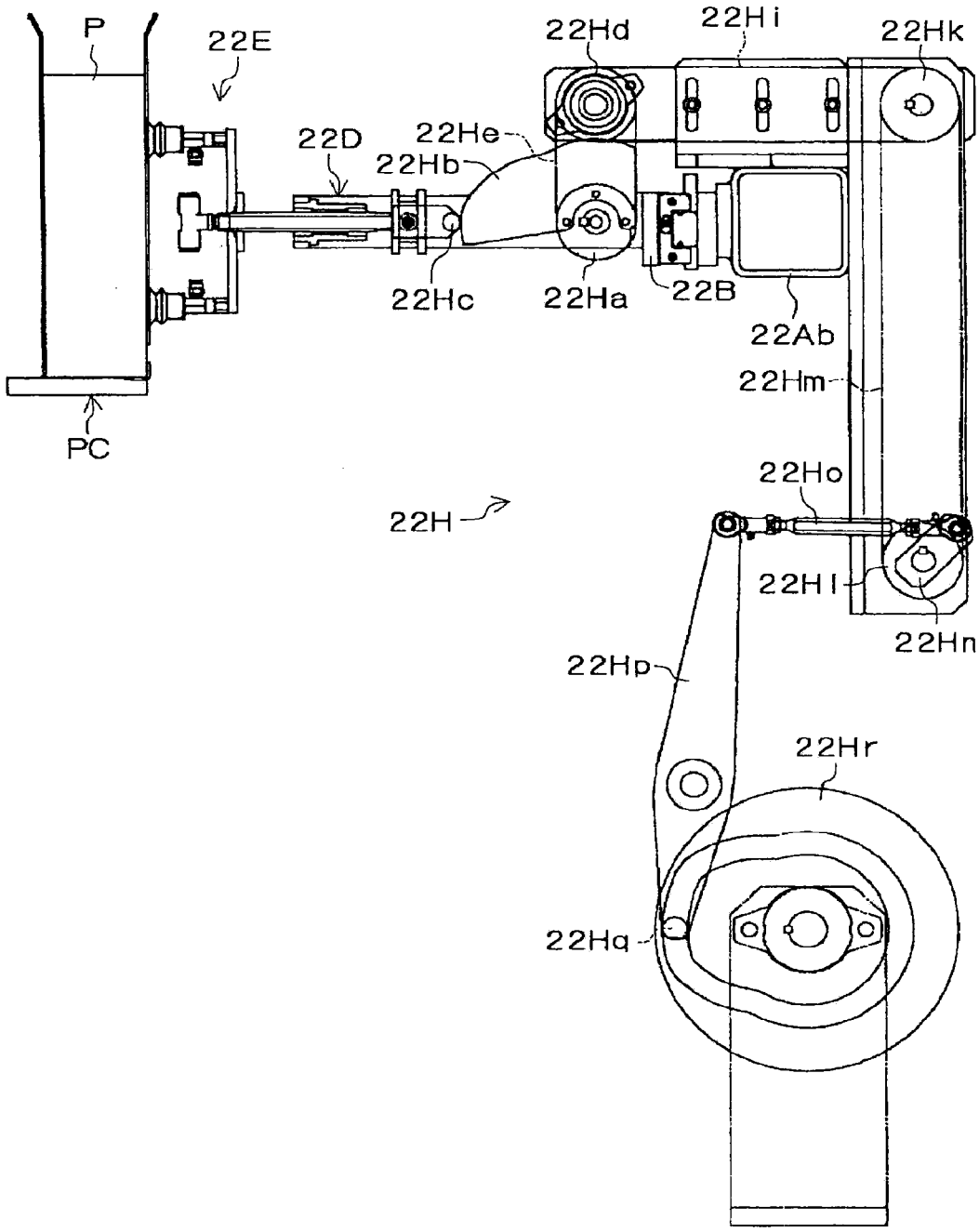
FIG. 12 is a side view illustrating a reciprocating driving mechanism that constitutes the pouch takeout unit illustrated in FIG. 9.
Figure 13:
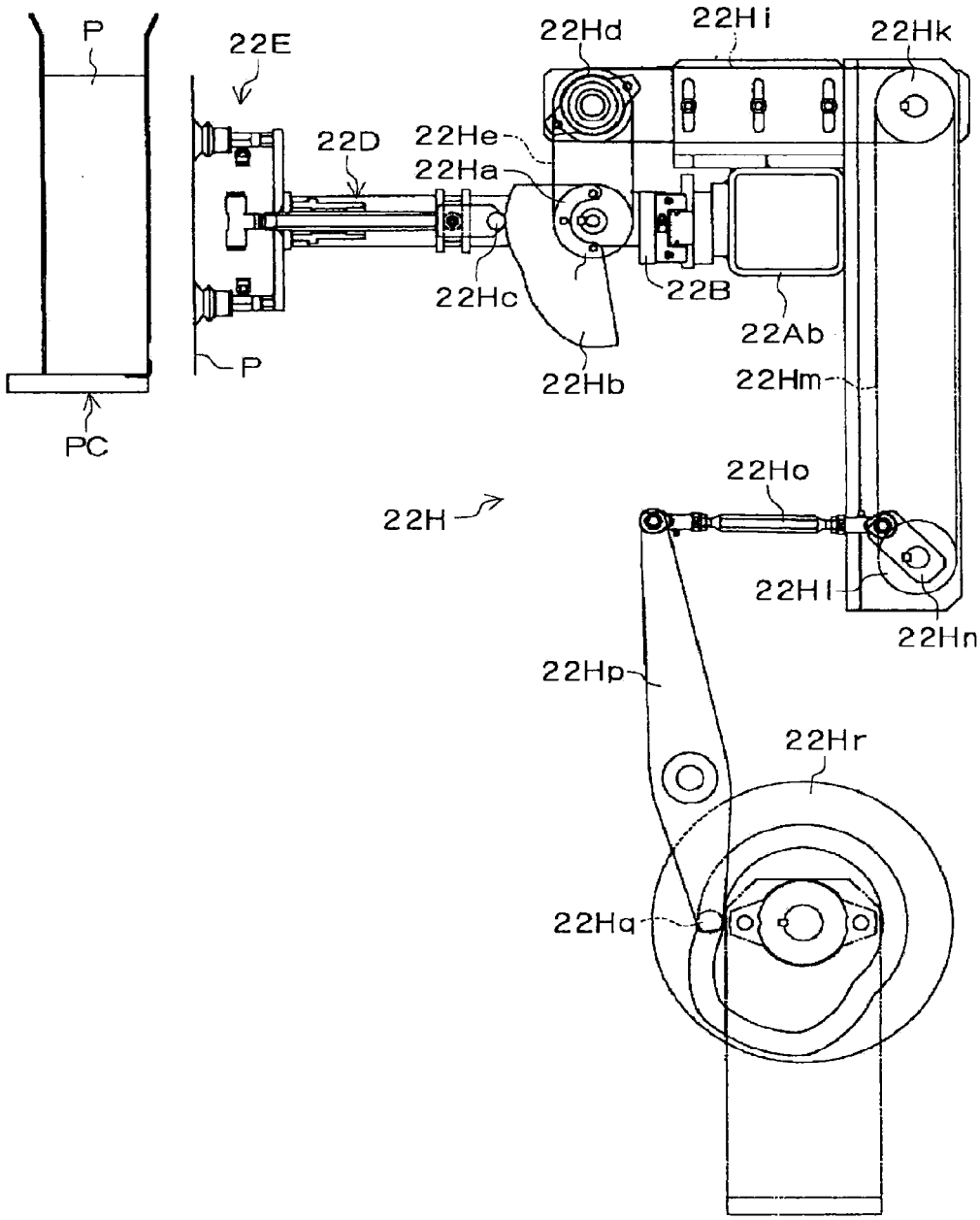
FIG. 13 is a side view illustrating an operation of the reciprocating driving mechanism illustrated in FIG. 12.

The above-described reciprocating driving mechanism 22H, as illustrated in FIGS. 9 to 13, includes a first pulley 22Ha supported by the horizontal drive shaft 22C (i.e., the movable side horizontal drive shaft 22Ca) so as to be rotatable. The reciprocating driving mechanism 22H further includes a cam mechanism constituted by a cam plate 22Hb fixed to the first pulley 22Ha and a cam follower 22Hc attached to the slide base 22Ed of the suction holding member 22E and abutting a cam surface of the cam plate 22Hb. The reciprocating driving mechanism 22H further includes a second pulley 22Hd supported by the slide base 22B at a position higher than the first pulley 22Ha, a belt 22He stretched around the first pulley 22Ha and the second pulley 22Hd, a third pulley 22Hg attached to a rotational shaft 22Hf of the second pulley 22Hd, and a fourth pulley 22Hh supported via a support member to the lateral frame 22Ab of the base frame 22A so as to be rotatable. The reciprocating driving mechanism 22H further includes a belt 22Hf stretched around the third pulley 22Hg and the fourth pulley 22Hh, a fifth pulley 22Hk attached to a rotational shaft 22Hf of the fourth pulley 22Hh, a sixth pulley 22Hl supported at a position lower than the fifth pulley 22Hk, and a belt 22Hm stretched around the fifth pulley 22Hk and the sixth pulley 22Hl. The reciprocating driving mechanism 22H further includes a lever 22Hn fixed to a rotational shaft of the sixth pulley 22Hl, a rod 22Ho connected to one end of the lever 22Hn by means of a pin, and a swing arm 22Hp supported at its central portion in the longitudinal direction so as to be swingable and having one end connected to the other end of the rod 22Ho by means of a pin. The reciprocating driving mechanism 22H further includes a cam mechanism for causing the swing arm 22Hp to swing. The cam mechanism includes a cam follower 22Hq attached to the other end of the swing arm 22Hp and a cam plate 22Hr having a cam groove formed on one surface with which the cam follower 22Hq can engage. When a driving means (not illustrated) rotates the cam plate 22Hr, respective pulleys 22Ha, 22Hd, 22Hg, 22Hh, 22Hk, and 22Hl can alternately rotate 90 degrees in opposite directions. Accordingly, the cam plate 22Hh alternately rotates 90 degrees in opposite directions. Therefore, as illustrated in FIGS. 12 and 13, an abutting position of the cam follower 22Hq moves in the reciprocating direction on the cam surface. According to this movement, the suction holding member 22E can repeat a reciprocating movement. The first pulley 22Ha and the second pulley 22Hd supported by the slide base 22B can move when the slide base 22B slides. Therefore, the rotational shaft 22Hf is constituted by a shaft body ms supported by the base frame 22A so as to be rotatable in a state where one end portion is attached to the third pulley 22Hg and a spline shaft ss connected to the other end portion of the shaft body ms. The spline shaft ss is connected, via a spline bearing sb, to the second pulley 22Hd. Further, a shaft portion sbs continuously formed with the spline bearing sb is supported by the slide base 22B so as to be rotatable. Accordingly, the movement of the second pulley 22Hd in the axial direction can be absorbed.

Figure 14:
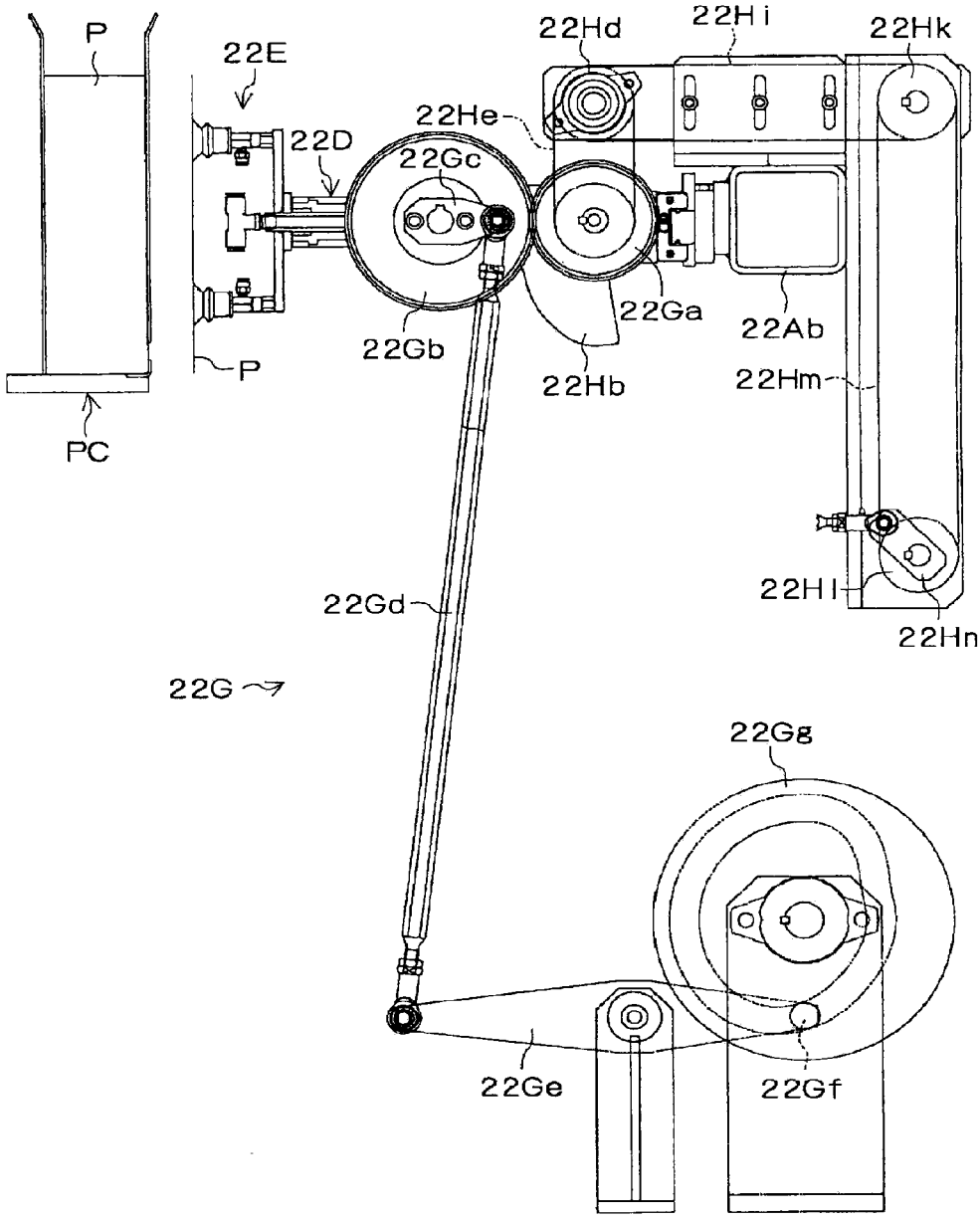
FIG. 14 is a side view illustrating a first rotational driving mechanism that constitutes the pouch takeout unit illustrated in FIG. 9.
Figure 18A:
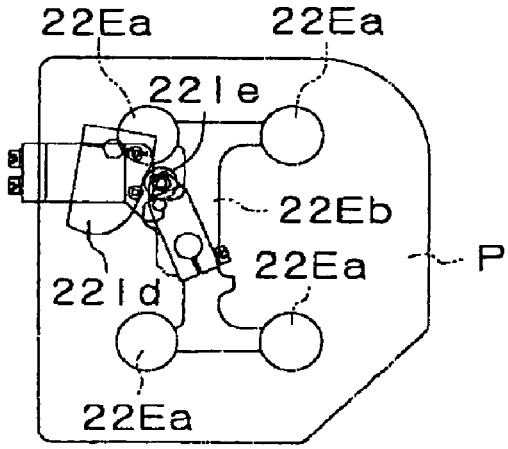
FIGS. 18(*a*) to 18(*c*) are operational views illustrating an operation of the second rotational driving mechanism illustrated in FIG. 17(*b*).
Figure 18B:
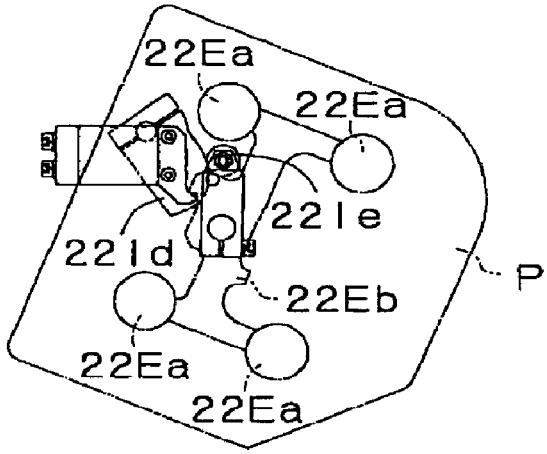
Figure 18C:
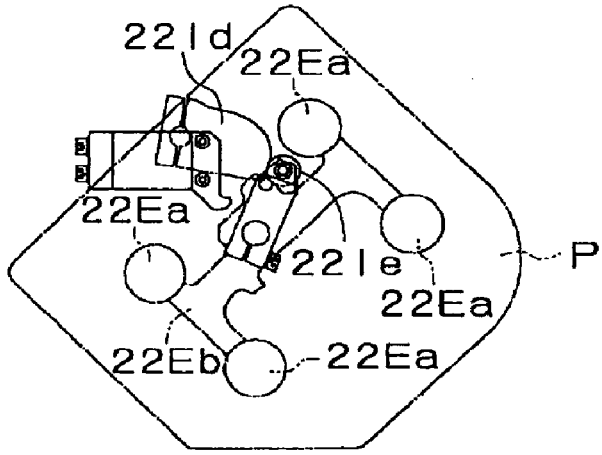

The above-described second rotational driving mechanism 22I, as illustrated in FIG. 17(*b*) and FIGS. 18(*a*) to 18(*c*), includes a bevel gear 22Ia fixed to the slide base 22B in a state where it is inserted in the horizontal drive shaft 22C so as to be relatively rotatable, a bevel gear 22Ib meshing with the bevel gear 22Ia and supported by one side plate 22Da of the intermediate frame 22D so as to be rotatable, a cam plate 22Id attached to a rotational shaft 22Ic of the bevel gear 22Ib, and a cam follower 22Ie that is fixed to the lever 22Eh attached to the suction pipe 22Ec of the suction holding member 22E and can abut a cam surface of the cam plate 22Id when the suction holding member 22E moves rearward. When the suction holding member 22E moves rearward in a state where the suction holding member 22E suction holds the pouch P, the pouch P is taken out of the pouch cassette PC as illustrated in FIG. 14. Subsequently, the intermediate frame 22D rotates from the horizontal state illustrated in FIG. 14 to the vertical state illustrated in FIG. 15. In accordance with the rotational movement of the intermediate frame 22D, the bevel gear 22Ib rotates and also the cam plate 22Id rotates. Therefore, as illustrated in FIGS. 18(*a*) to 18(*c*), the cam plate 22Id pushes the lever 22Eh fixed to the cam follower 22Ie upward. Accordingly, the suction pipe 22Ec and the support plate 22Eh rotate 45 degrees, respectively. The pouch P being suction held by the suction heads 22Ea can rotates 45 degrees about the suction pipe 22Ec.

First, according to the pouch takeout unit 22 having the above-described configuration, the suction holding member 22E moves forward in a state where the intermediate frame 22D is supported horizontally, as illustrated in FIGS. 9, 10, and 12. Then, the suction holding member 22E suction holds the frontmost pouch P in the pouch cassette PC. Then, as illustrated in FIG. 16(*b*), the pouch takeout unit 22 causes the slide base 22B to slide to slightly move the intermediate frame 22D in the lateral direction. And then, as illustrated in FIG. 16(*a*), it returns to an original position. Subsequently, as illustrated in FIGS. 13 and 14, the suction holding member 22E moves backward to take the pouch P out of the pouch cassette PC. In this case, as described above, by slightly moving the intermediate frame 22D in the lateral direction, as illustrated in FIG. 16(*b*), the suction held pouch P is partly separated from the next pouch P. Therefore, the pouch takeout unit 22 can accurately prevent two pouches P, which are adhered to each other, from being simultaneously taken out, i.e., a so-called double feed.

Figure 15:
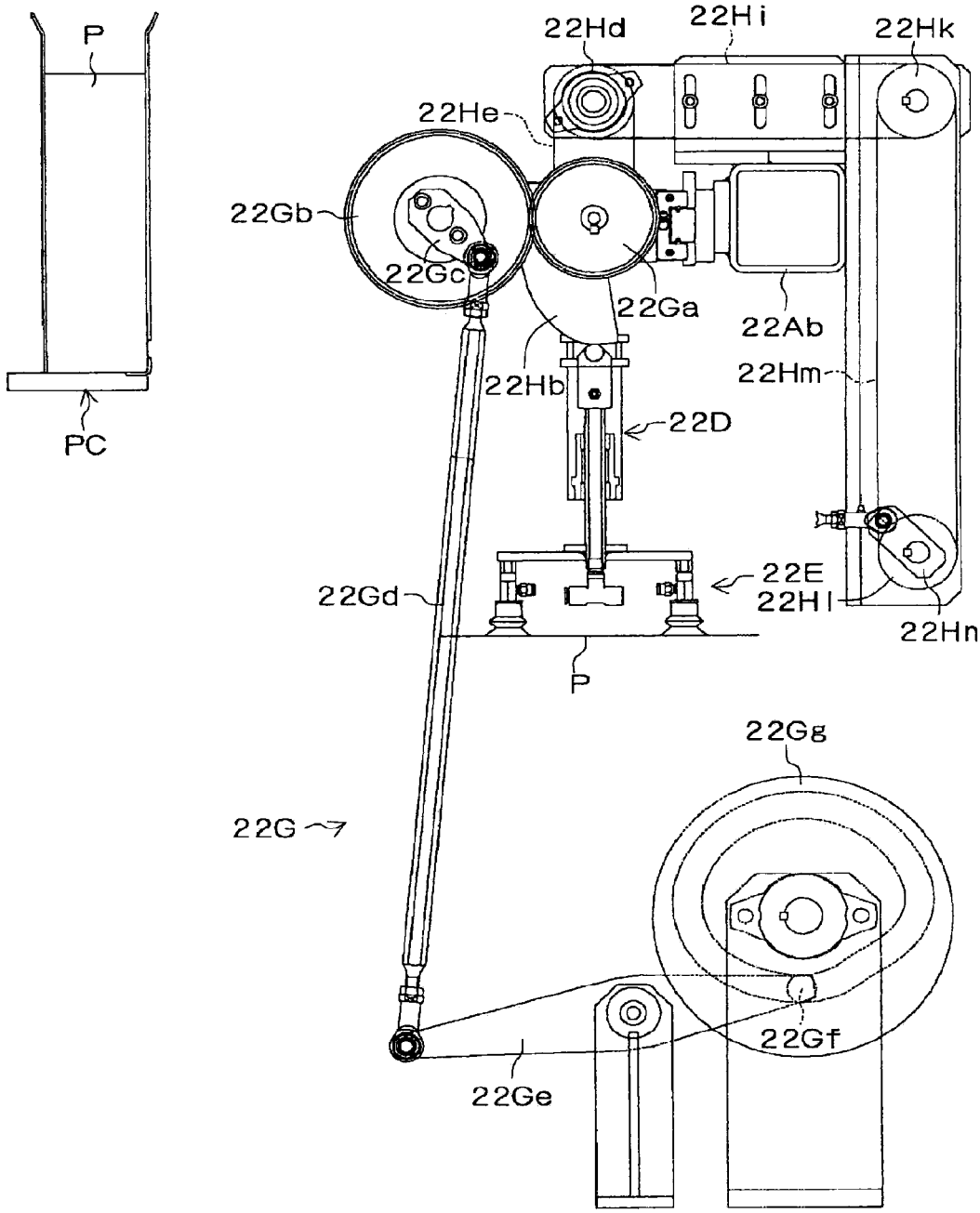
FIG. 15 is a side view illustrating an operation that can be performed by the first rotational driving mechanism illustrated in FIG. 14.

Subsequently, the intermediate frame 22D rotates until the suction heads 22Ea face downward as illustrated in FIG. 15. Then, the pouch takeout unit 22 stops applying a suction pressure to the suction heads 22Ea to transfer the pouch P to the positioning unit 23. When the intermediate frame 22D rotates, the suction heads 22Ea rotate 45 degrees about the suction pipe 22Ec as illustrated in FIGS. 18(*a*) to 18(*c*). Therefore, the pouch P being suction held by the suction heads 22Ea also rotates 45 degrees. Therefore, as illustrated in FIGS. 1 and 19, in a state where the upper inclined edge SE of the pouch P onto which the inlet spout SA can be installed faces the pouch supply position β1 (β2), the pouch P can be transferred to the positioning unit 23.

Figure 19:
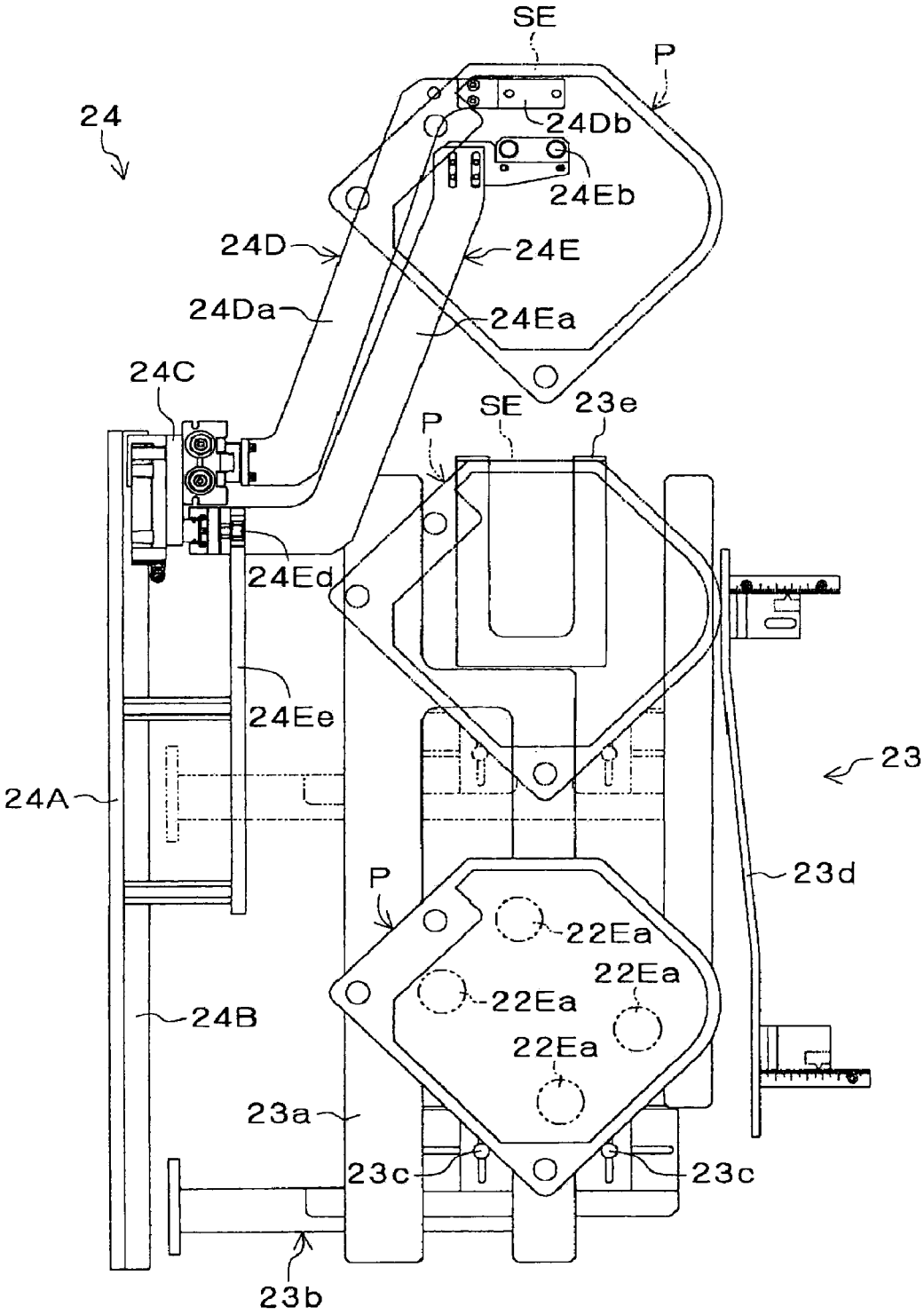
FIG. 19 is a plan view illustrating a positioning unit and a pouch transport unit mounted on the spout installation device illustrated in FIG. 1.

The above-described positioning unit 23, as illustrated in FIG. 19, includes a base plate 23*a* that can mount the pouch P, and a pusher 23*b* that can push the pouch P placed on a rear end portion of the base plate 23*a*, which is mounted by the pouch takeout unit 22, toward a front end side of the base plate 23*a* with a pair of pins 23*c* that are bought into contact with a lower edge and a side edge on the gusset portion GP side. The positioning unit 23 further includes a side guide 23*d* disposed along one side of the base plate 23*a* with a clearance provided at its rear relative to the base plate 23*a*. The clearance of the side guide 23*d* relative to the base plate 23*a* gradually decreases when the clearance position approaches the front end. The positioning unit 23 further includes a stopper 23*e* disposed at the front end side of the base plate 23*a*. The stopper 23*e* is moveable in the up-and-down direction. When the pouch P is pushed forward by the pusher 23*b*, the pouch P abuts the side guide 23*d* at its lower corner portion (i.e., an R shaped portion). The side guide 23*d* performs positioning of the moving pouch P in the lateral direction. Meanwhile, the upper inclined edge SE of the pouch P onto which the inlet spout SA can be installed abuts the stopper 23*e*. The stopper 23*e* performs positioning of the conveyed pouch P in the reciprocating direction.

Figure 20A:
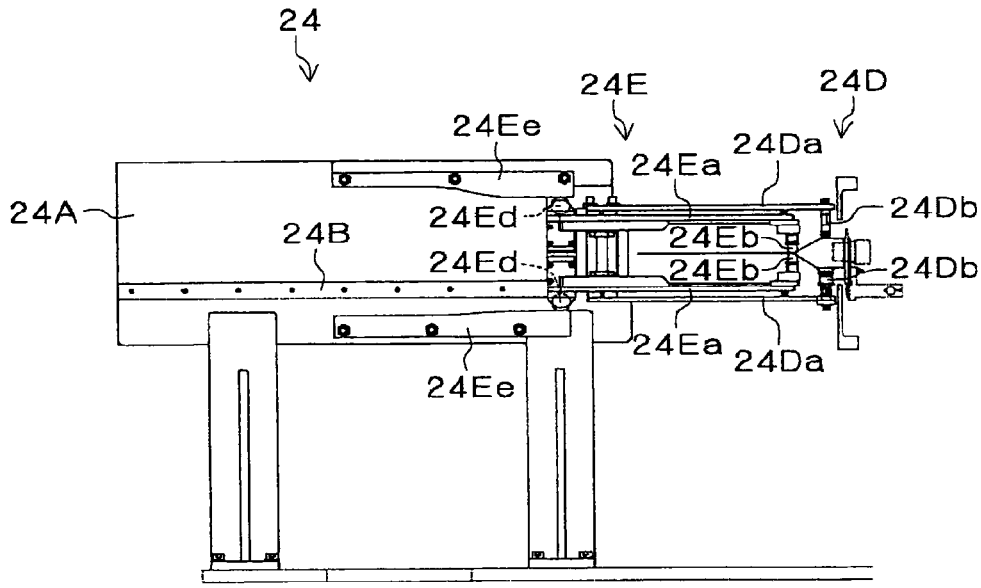
FIG. 20(*a*) is a side view illustrating the pouch transport unit illustrated in FIG. 19.
Figure 20B:
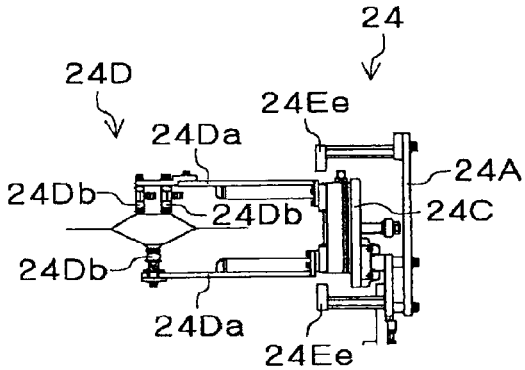
Figure 20C:
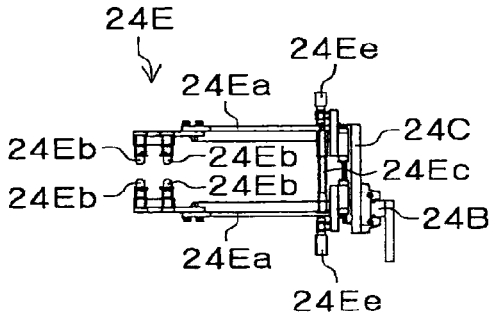
Figure 21A:
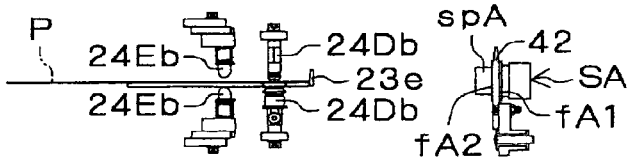
FIGS. 21(*a*)-21(*f*) are an operational view illustrating an operation that can be performed by the pouch transport unit illustrated in FIG. 19.
Figure 21B:
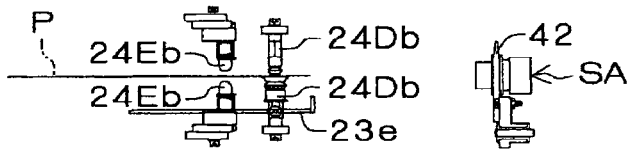
Figure 21C:
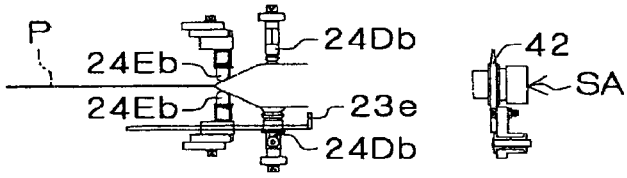
Figure 21D:
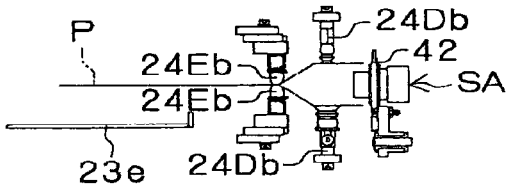
Figure 21E:
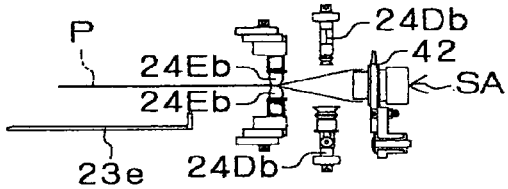
Figure 21F:
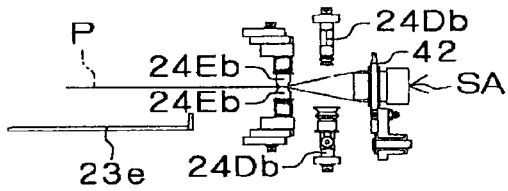

The above-described pouch transport unit, as illustrated in FIG. 19 and FIGS. 20(*a*) to 20(*c*), includes a base plate 24A vertically extending along the other side portion of the base plate 23*a* of the positioning unit 23, a slide rail 24B fixed to the base plate 24A, a slide base 24C slidable along the slide rail 24B, and a clamper-opener 24D and an auxiliary clamper 24E attached to the slide base 24C. The slide base 24C can be moved in the reciprocating direction by a driving means (not illustrated).

The above-described clamper-opener 24D includes a pair of upper and lower supporting arms 24Da having proximal end portions supported by the slide base 24C and capable of approaching to and departing from each other in the up-and-down direction and suction heads 24Db attached to distal end portions of the pair of upper and lower supporting arms 24Da. When the pair of upper and lower supporting arms 24Da approach to each other, the suction heads 24Db can sandwich the upper inclined edge SE of the pouch P. Further, in a state where the pouch P is suction held in the vicinity of the upper inclined edge SE, the pair of upper and lower supporting arms 24Da depart from each other to open the non-sealed upper inclined edge SE of the pouch P.

The auxiliary clamper 24E includes a pair of upper and lower supporting arms 24Ea supported by the slide base 24C and capable of mutually approaching and departing in the up-and-down direction, clamp pins 24Eb attached to distal end portions of the pair of upper and lower supporting arms 24Ea, and a spring 24Ec resiliently urging the pair of upper and lower supporting arms 24Ea in a mutually departing direction. The auxiliary clamper 24E further includes a cam mechanism that is cooperative with the spring 24Ec to move the pair of upper and lower supporting arms 24Ea in mutually approaching and departing directions, thereby enabling the clamp pins 24Eb to hold and release the pouch P. The cam mechanism includes cam followers 24Ed attached to proximal end portions of the pair of upper and lower supporting arms 24Ea and a pair of upper and lower cam plates 24Ee having cam surfaces, which can be brought into contact with the cam followers 24Ed, and attached to the base plate 24A.

An operation for transporting the pouch P that can be performed by the pouch transport unit 24 having the above-described configuration is described below with reference to FIG. 21. First, as illustrated in FIG. 21(*a*), in a state where the pouch P is positioned by the stopper 23*e* of the positioning unit 23 that can abut the upper inclined edge SE of the pouch P onto which the inlet spout SA can be installed, the suction heads 24Db of the clamper-opener 24D sandwich and suction hold the pouch P in the vicinity of the upper inclined edge SE to receive the pouch P. Then, as illustrated in FIG. 21(*b*), the stopper 23*e* of the positioning unit 23 moves downward.

Subsequently, as illustrated in FIG. 21(*c*), the upper and lower suction heads 24Db of the clamper-opener 24D depart from each other to open the non-sealed upper inclined edge SE of the pouch P. Then, as illustrated in FIG. 21(*d*), the slide base 24C slides forward to convey the pouch P to the pouch supply position β1 (β2). At the pouch supply position β1 (β2), the opened upper inclined edge SE of the pouch P is coupled with the installation portion spA of the inlet spout SA while the pouch P is gripped by clamp pins 24Eb of the auxiliary clamper 24E. In this case, a small clearance is provided between the upper inclined edge SE of the pouch P and a flange fA2 of the inlet spout SA.

Then, as illustrated in FIG. 21(*e*), after the suction heads 24Db are released from the suction pressure, the upper and lower suction heads 24Db depart from each other. Then, as illustrated in FIG. 21(*f*), the slide base 24C slightly slides forward to cause the upper inclined edge SE of the pouch P to abut the flange fA2 of the inlet spout SA.

The above-described first spout supply section 3A, as illustrated in FIG. 1, include parts feeders 31A and 31A that are vibratory bowl feeders capable of adjusting the inlet spouts SA in both direction and orientation and conveyance guides 32A and 32A that can guide the inlet spouts SA having been adjusted in direction and orientation by the parts feeders 31A and 31A to the spout supply positions γ1 and γ2 while aligning them in the upright state. The above-described second spout supply section 3B, as illustrated in FIG. 1, include parts feeders 31B and 31B that are vibratory bowl feeders capable of adjusting the outlet spouts SB in both direction and orientation and conveyance guides 32B and 32B that can guide the outlet spouts SB having been adjusted in direction and orientation by the parts feeders 31B and 31B to the spout supply positions δ1 and δ2 while aligning them in the upright state. Thus, the inlet spouts SA and the outlet spouts SB in the upright state can be supplied to the spout supply positions γ1 and γ2 and the spout supply positions δ1 and δ2, respectively.

Figure 22:
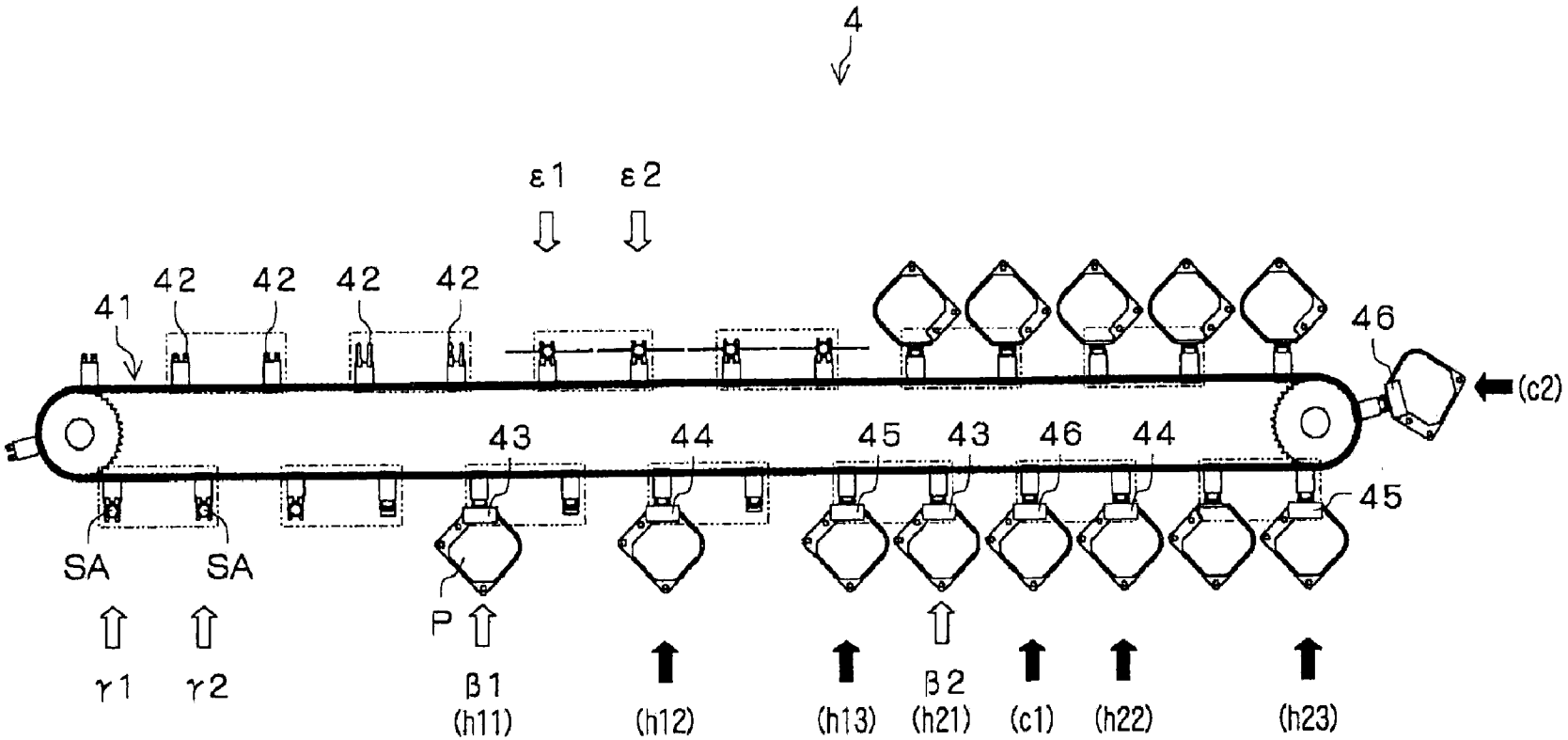
FIG. 22 is a plan view schematically illustrating a first spout installation section of the spout installation device illustrated in FIG. 1.
Figure 23A:
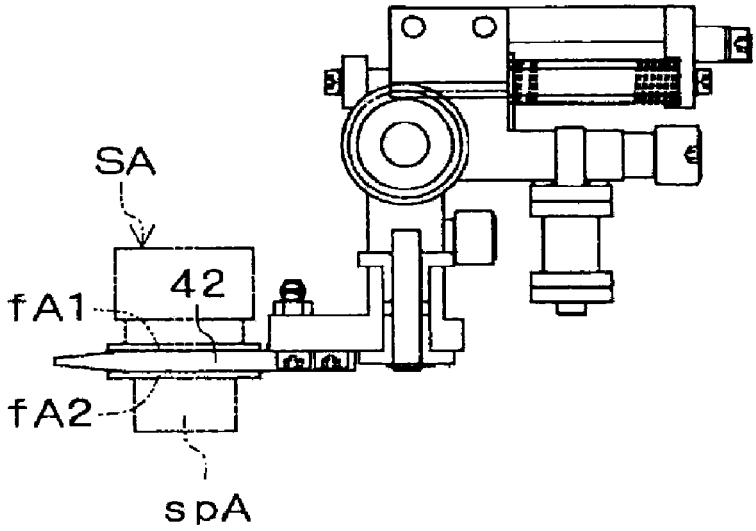
FIGS. 23(*a*) and 23(*b*) are side views illustrating a damper that constitutes a conveyor unit mounted on the first spout installation section illustrated in FIG. 22 and an operation that can be performed by the damper.
Figure 23B:
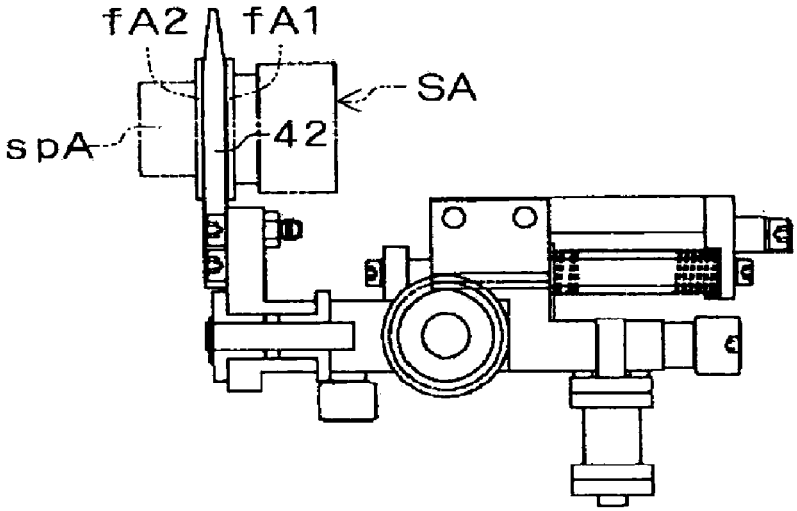

The above-described first spout installation section 4, as illustrated in FIG. 22, includes a conveyor unit 41 that can receive respective inlet spouts SA supplied to the spout supply positions γ1 and γ2 and successively convey the received inlet spouts SA, while gripping the inlet spouts SA with clampers 42, from the spout supply positions γ1 and γ2 to transfer positions ϵ1 and ϵ2 via the pouch supply position (first seal position) β1 and β2 (h11, h21), a second seal position (h12, h22), a third seal position (h13, h23), and a cooling position (c1, c2). The first spout installation section 4 further includes seal bars 43, 44, and 45 provided at the first to third seal positions and cooling bars 46 provided at the cooling positions. The above-described clamper 42, as illustrated in FIG. 23(*a*), receives the inlet spout SA held in the upright state that is supplied by the spout supply section 3A at the spout supply positions γ1 and γ2 while gripping the upright inlet spout SA at an intermediate portion between two flanges fA1 and fA2. Then, at the next stop position, as illustrated in FIG. 23(*b*), the clamper 42 rises up to rotate the inlet spout SA into a laid-down state. The clamper 42 continuously conveys the inlet spout SA in this laid-down state. Then, at the stop position immediately before the transfer positions ϵ1 and ϵ2, the clamper 42 is laid down to return the inlet spout SA to the upright state.

Figure 24:
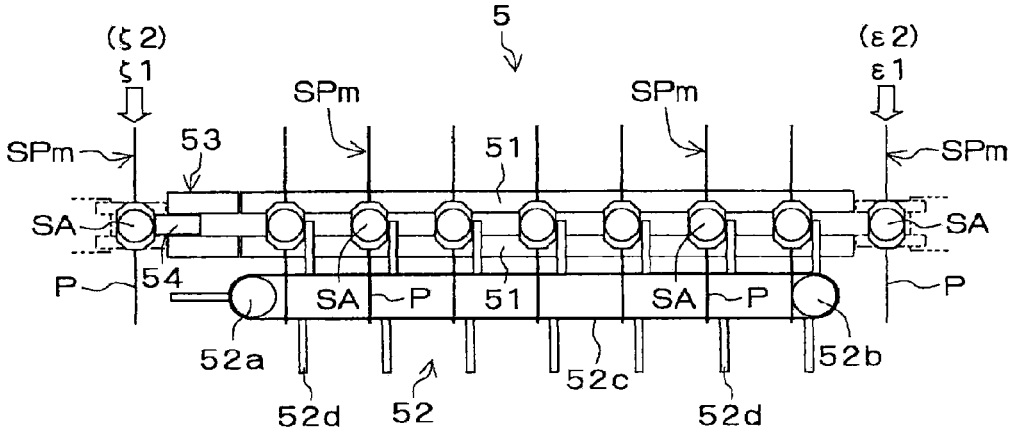
FIG. 24 is a plan view schematically illustrating a transfer section of the spout installation device illustrated in FIG. 1.

The above-described transfer section 5, as illustrated in FIGS. 1 and 24, includes a pair of conveyance guide rails 51 that can guide the spout-attached intermediate pouch SPm being hung at its inlet spout SA portion from the transfer positions ϵ1 and ϵ2 to receiving positions ζ1 and ζ2, and a conveyor means 52 that can convey the spout-attached intermediate pouch SPm along the conveyance guide rails 51. The transfer section 5 further includes an inclining means 53 for inclining the spout-attached intermediate pouch SPm to cause the lower edge DE of the pouch P to face downward at a position immediately before the receiving positions ζ1 and ζ2, and a pusher 54 that can push the inclined spout-attached intermediate pouch SPm to the receiving positions ζ1 and ζ2. The conveyance guide rails 51 are configured to engage, from both sides of the conveyance path, with the inlet spout SA between the upper and lower flanges fA1 and fA2, to hang the spout-attached intermediate pouch SPm. Although not illustrated, the first spout installation section 4 includes a pusher that can push the spout-attached intermediate pouch SPm having been conveyed to the transfer positions E1 and E2 toward the transfer section 5 and can engage the upper and lower flanges fA1 and fA2 of the inlet spout SA with end portions of the pair of conveyance guide rails 51.

Figure 25:
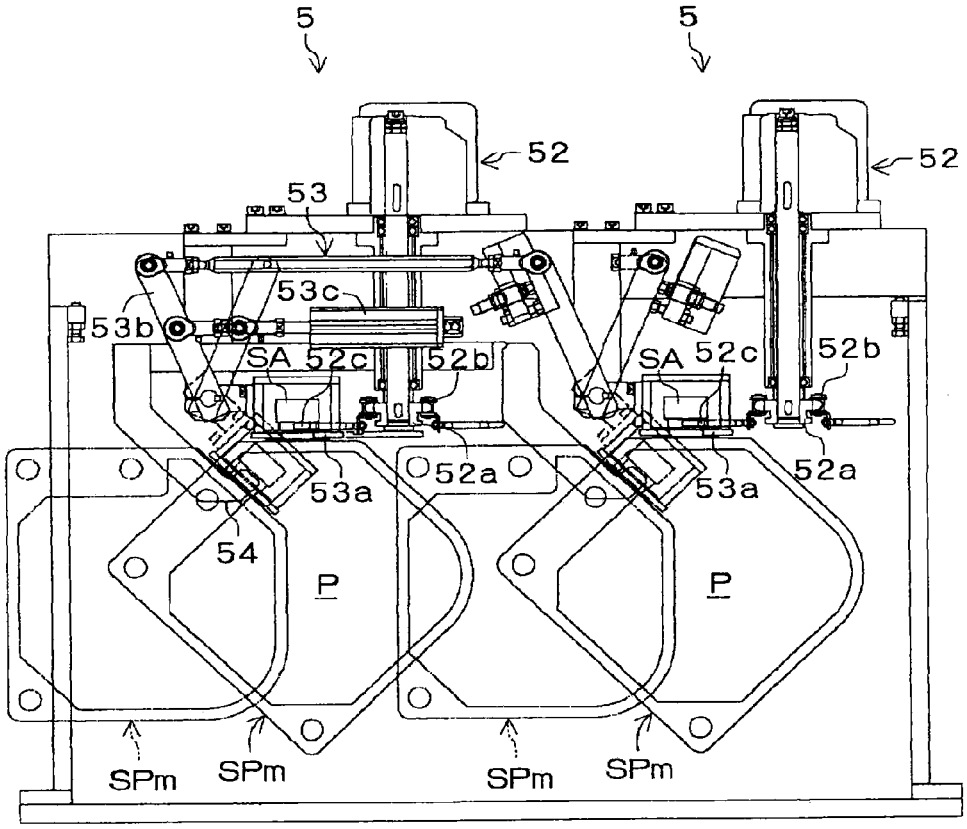
FIG. 25 is a front view illustrating the transfer section illustrated in FIG. 24.

The above-described conveyor means 52, as illustrated in FIGS. 24 and 25, includes a driving sprocket 52*a* disposed on the second spout installation section 6 side, a driven sprocket 52*b* disposed on the first spout installation section 4 side, an endless chain 52*c* stretched around the driving sprocket 52*a* and the driven sprocket 52*b*, and numerous spring arms 52*d* attached to the chain 52*c* at predetermined intervals. When the chain 52*c* intermittently moves and rotates at predetermined pitches, respective spring arms 52*d* can push the inlet spout SA portion of the spout-attached intermediate pouch SPm having been conveyed to the transfer positions ϵ1 and ϵ2.

The above-described inclining means 53, as illustrated in FIGS. 24 and 25, similar to the pair of conveyance guide rails 51, includes a gate-type hanging member 53*a* having an engaging portion that can enter between the flanges fA1 and fA2 of the inlet spout SA of the spout-attached intermediate pouch SPm, a link mechanism 53*b* connected to the hanging member 53*a*, and a drive cylinder 53*c* that can drive the link mechanism 53*b*. When the drive cylinder 53*c* is operated, the spout-attached intermediate pouch SPm can be entirely inclined from a state indicated by a solid line illustrated in FIG. 25 where the inlet spout SA faces upward, namely, from a state where the lower edge DE of the pouch P is inclined, to a state indicated by an alternate long and two short dashes line illustrated in FIG. 25 where the lower edge DE of the pouch P faces downward.

Figure 26:
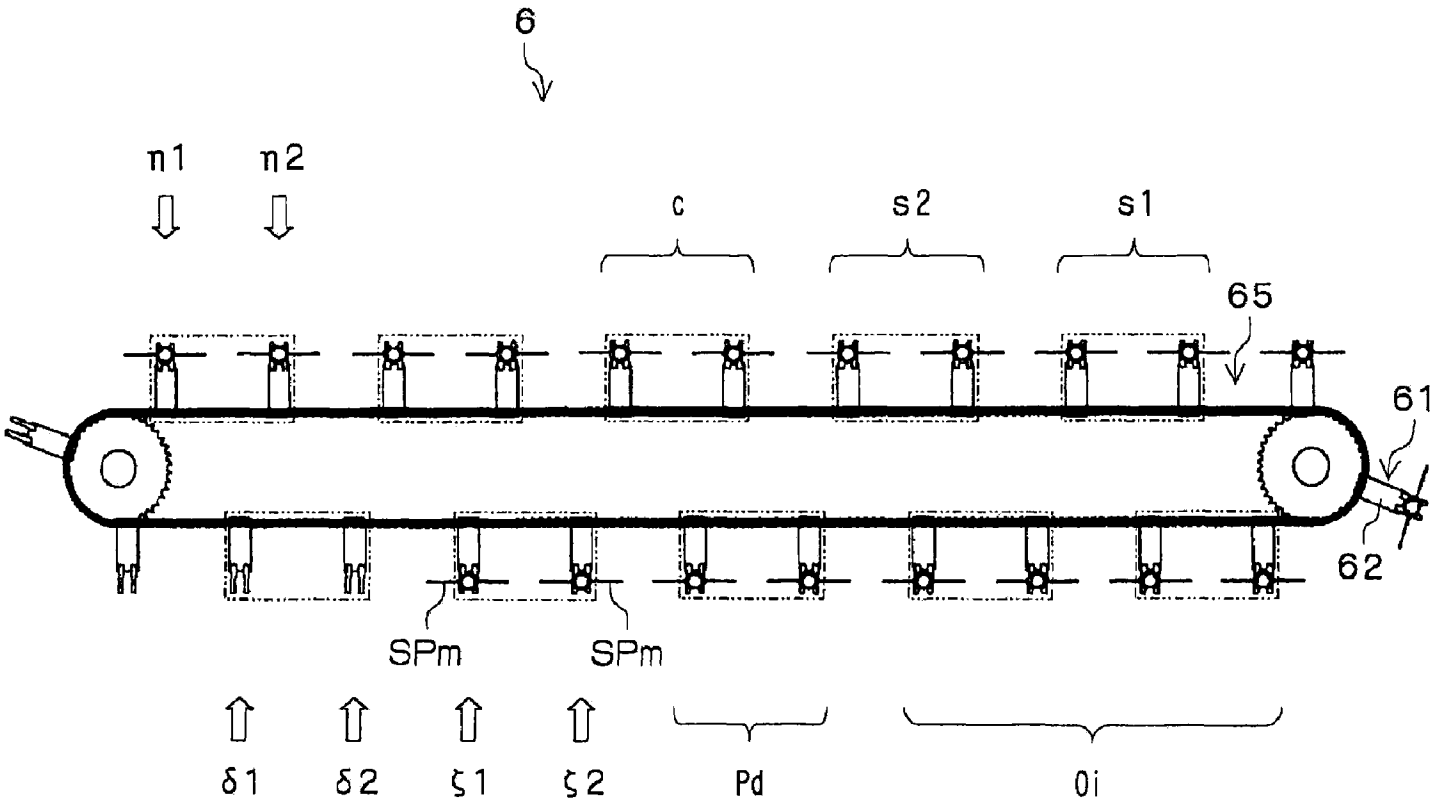
FIG. 26 is a plan view schematically illustrating a second spout installation section of the spout installation device illustrated in FIG. 1.
Figure 27:
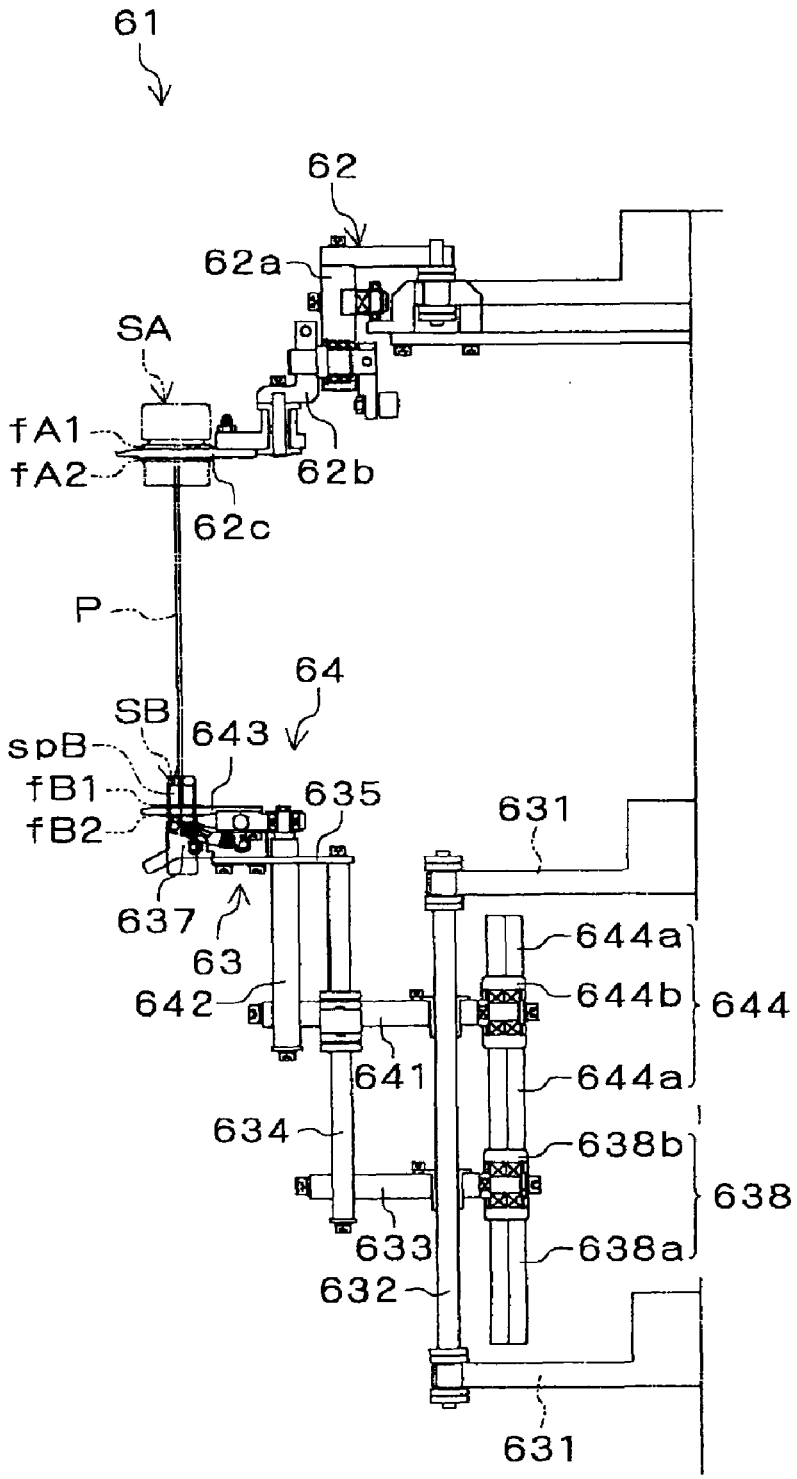
FIG. 27 is a cross-sectional view illustrating a first clamp mechanism, a positioning-gripping mechanism, and a second clamp mechanism that constitute the second spout installation section illustrated in FIG. 26.

The above-described second spout installation section 6, as illustrated in FIG. 1 and FIGS. 26 and 27, includes numerous spout installation heads 61. Each spout installation head 61 includes a first clamp mechanism 62 that can receive the spout-attached intermediate pouch SPm supplied to the receiving positions ζ1 and ζ2 in a state where the lower edge DE of the pouch P faces downward by gripping the inlet spout SA between the flanges fA1 and fA2, a positioning-gripping mechanism 63 that can position and grip the lower edge DE of the pouch P of the spout-attached intermediate pouch SPm, and a second clamp mechanism 64 that can receive the outlet spout SB having been supplied to the spout supply positions δ1 and 52 by gripping the outlet spout SB between flanges fB1 and fB2. A conveyor unit 65 circulates these spout installation heads 61 so as to move along a path connecting the spout supply positions δ1 and δ2, the receiving positions ζ1 and ζ2, a positioning position pd, the opening-insertion position oi, a first seal position s1, a second seal position s2, a cooling position c, and delivery positions η1 and η2.

Figure 28A:
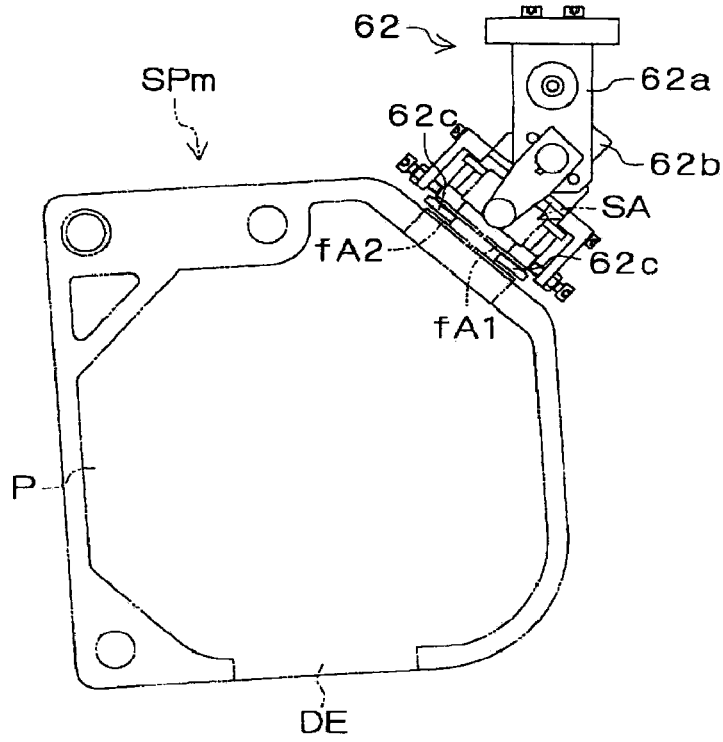
FIGS. 28(*a*) and 28(*b*) are views illustrating a swinging state of a spout-attached intermediate pouch having an inlet spout gripped by the first clamp mechanism illustrated in FIG. 27.
Figure 28B:
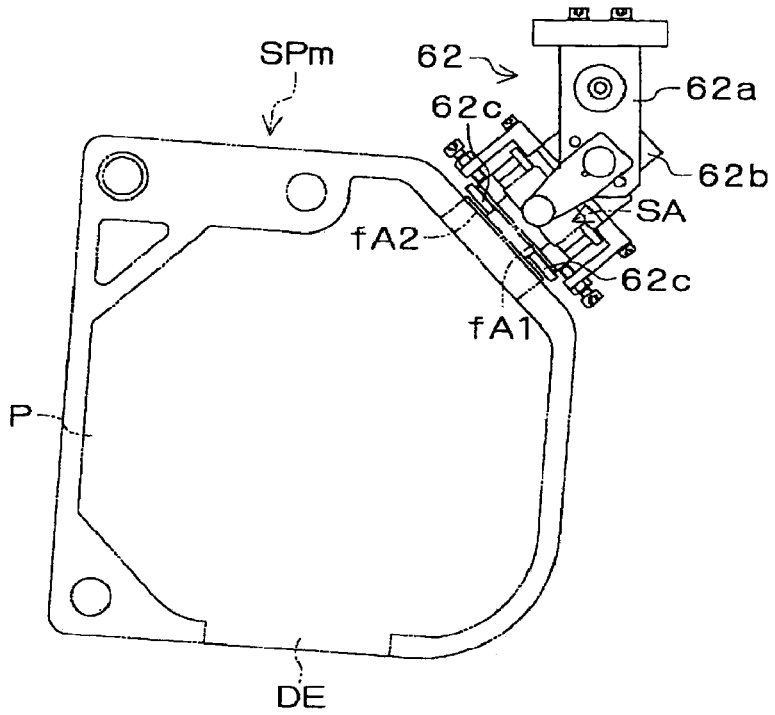

The above-described first clamp mechanism 62, as illustrated in FIG. 27, includes a swing arm 62*b* supported in a swingable state by a support member 62*a* connected to the conveyor unit 65, and a clamper 62*c* supported by the swing arm 62*b* so as to be opened and closed. The clamper 62*c* can grip the inlet spout SA between the flanges fA1 and fA2. Accordingly, when the clamper 62*c* receives the spout-attached intermediate pouch SPm by gripping the inlet spout SA between the flanges fA1 and fA2, the lower edge DE of the pouch P onto which the outlet spout SB can be installed can swing between a diagonally right down state and a diagonally left down state as illustrated in FIGS. 28(*a*) and 28(*b*).

Figure 29:
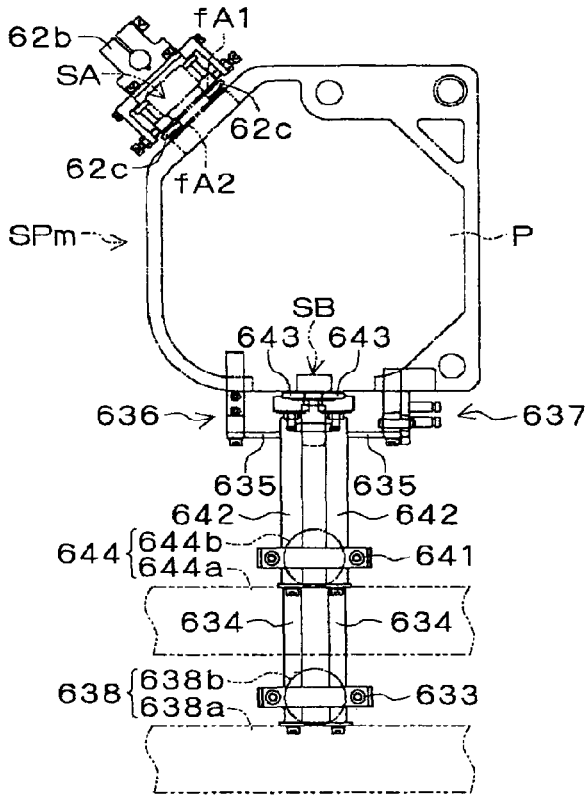
FIG. 29 is a front view illustrating the first clamp mechanism, the positioning-gripping mechanism, and the second clamp mechanism illustrated in FIG. 27.
Figure 30A:
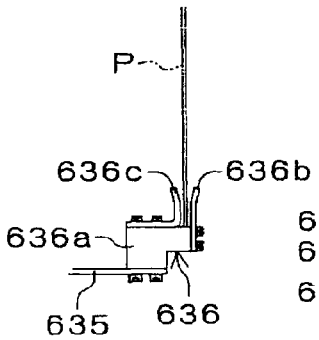
FIGS. 30(*a*) and 30(*c*) are side view illustrating the positioning-gripping mechanism illustrated in FIG. 27.
Figure 30B:
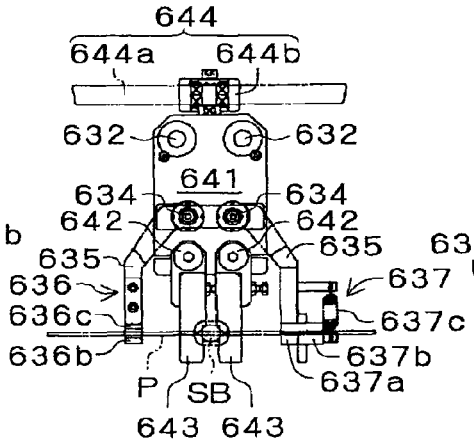
Figure 30C:
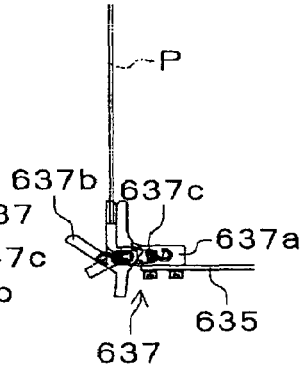

The above-described positioning-gripping mechanism 63, as illustrated in FIGS. 27, 29, and 30, includes a pair of right and left support rods 632 and 632 supported by support members 631 and 631 connected to the conveyor unit 65, a base plate 633 supported by the support rods 632, 632 so as to be movable in the up-and-down direction, and a pair of right and left support rods 634 and 634 fixed to a front end side of the base plate 633. The positioning-gripping mechanism 63 further includes a pair of right and left supporting arms 635 and 635 fixed to upper end portions of the support rods 634 and 634, a positioning member 636 and a positioning grip member 637 attached to distal ends of the supporting arms 635 and 635, and a cam mechanism 638 that can raise and lower the base plate 633. The above-described cam mechanism 638 includes a cam plate 638*a* disposed along a conveyance path of the spout installation head 61 and a cam follower 638*b* that abuts a cam surface of the cam plate 638*a*.

The above-described positioning member 636, as illustrated in FIG. 30(*a*), includes a base member 636*a* fixed to the supporting arm 635 and having an upper surface that can abut the lower edge DE of the pouch P of the spout-attached intermediate pouch SPm, and upstanding pieces 636*b* and 636*c* fixed to the base member 636*a* and capable of sandwiching the lower edge DE of the pouch P. These upstanding pieces 636*b* and 636*c* can prevent the lower edge DE of the pouch P, which is brought into contact with the upper surface of the base member 636*a*, from falling off the upper surface of the base member 636*a*.

The above-described positioning grip member 637, as illustrated in FIG. 30(*c*), includes a base member 637*a* fixed to the supporting arm 635 and having a stepped upper surface formed on a front end side that can abut the lower edge DE of the pouch P of the spout-attached intermediate pouch SPm, a rotary piece 637*b* supported by the base member 637*a* so as to be rotatable and capable of gripping the lower edge DE of the pouch P by pushing it against a stepped front surface of the base member 637*a*, and a spring 637*c* having both end portions connected to the base member 637*a* and the rotary piece 637*b* and capable of resiliently urging a gripping face of the rotary piece 637*b* in a direction departing from the stepped front surface of the base member 637*a*. The stepped upper surface of the base member 637*a* and the upper surface of the base member 636*a* of the positioning member 636 are positioned at the same height.

Figure 31A:
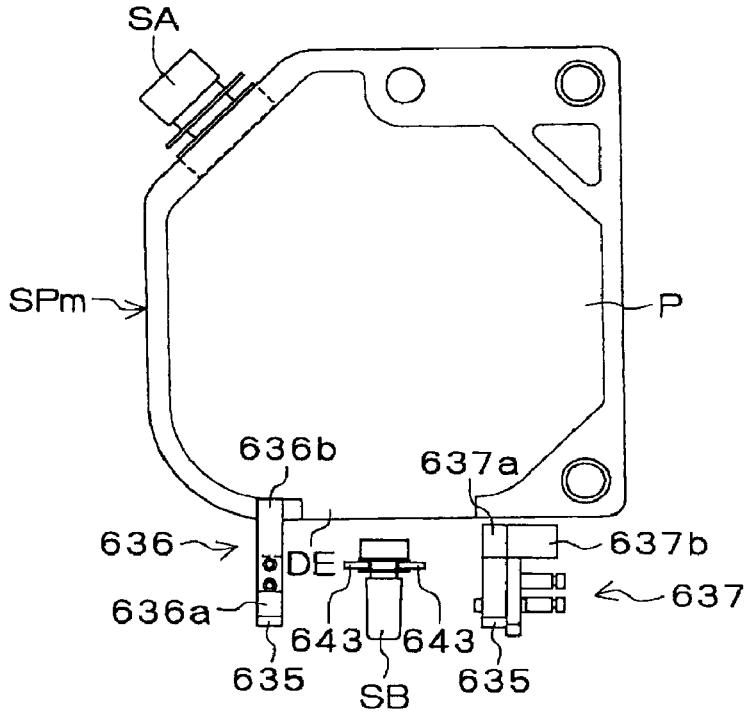
FIGS. 31(*a*) and 31(*b*) are views illustrating a pouch positioning operation that can be performed by the positioning-gripping mechanism illustrated in FIG. 27.
Figure 31B:
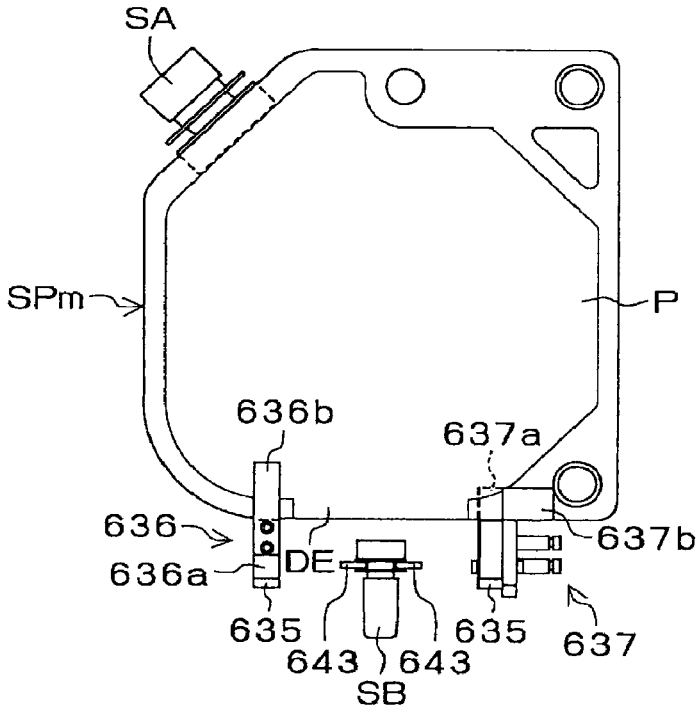

Accordingly, as illustrated in FIG. 31(*a*), after the first clamp mechanism 62 receives the spout-attached intermediate pouch SPm at the receiving positions ζ1 and ζ2, the cam mechanism 638 raises the base plate 633 at the positioning position pd. Then, as illustrated in FIG. 31(*b*), the positioning member 636 and the positioning grip member 637 slightly raise the lower edge DE of the spout-attached intermediate pouch SPm that is supported in a swingable state by the first clamp mechanism 62. The spout-attached intermediate pouch SPm causes a swing motion so that the lower edge DE onto which the outlet spout SB can be installed is positioned in a horizontal state. Thereafter, the rotary piece 636*b* of the positioning grip member 637 rotates to grip the pouch P by pressing its lower edge portion against the stepped front surface of the base member 637*a*, thereby holding the positioned state.

The above-described second clamp mechanism 64, as illustrated in FIGS. 27, 29, and 30, includes a base plate 641 supported by the pair of right and left support rods 634 and 634 of the positioning-gripping mechanism 63 so as to be movable in the up-and-down direction, a pair of right and left support rods 642 and 642 fixed to a front end side of the base plate 641, clampers 643 and 643 supported by upper end portions of the support rods 642 and 642 so as to be opened and closed and capable of gripping the outlet spout SB between the flanges fB1 and fB2, and a cam mechanism 644 that can raise and lower the base plate 641. The above-described cam mechanism 644 includes a cam plate 644*a* disposed along the conveyance path of the spout installation head 61 and a cam follower 644*b* that abuts a cam surface of the cam plate 644*a*.

Figure 32A:
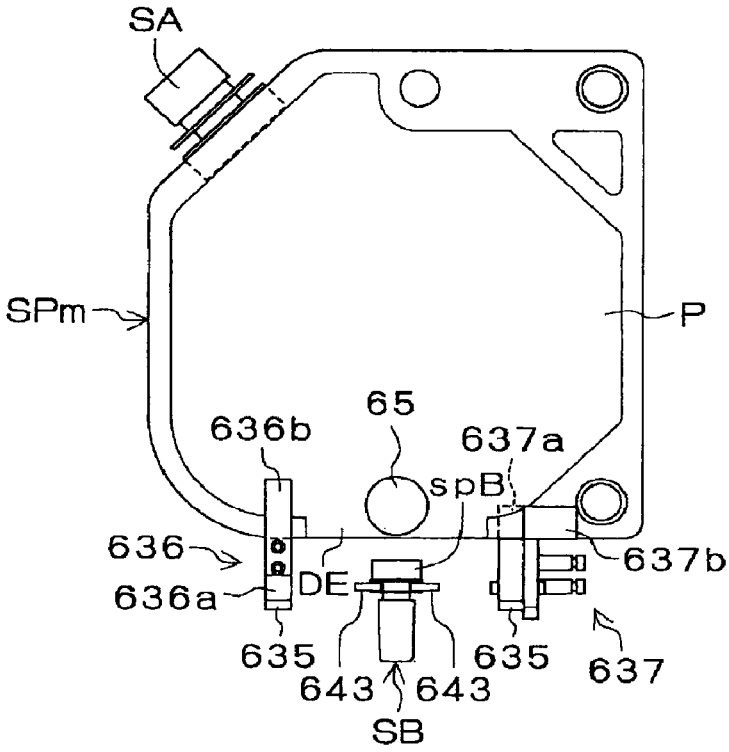
FIGS. 32(*a*) and 32(*b*) are views illustrating an operation for opening a lower edge of the spout-attached intermediate pouch and an operation for inserting an outlet spout that can be performed by the second spout installation section illustrated in FIG. 26.
Figure 32B:
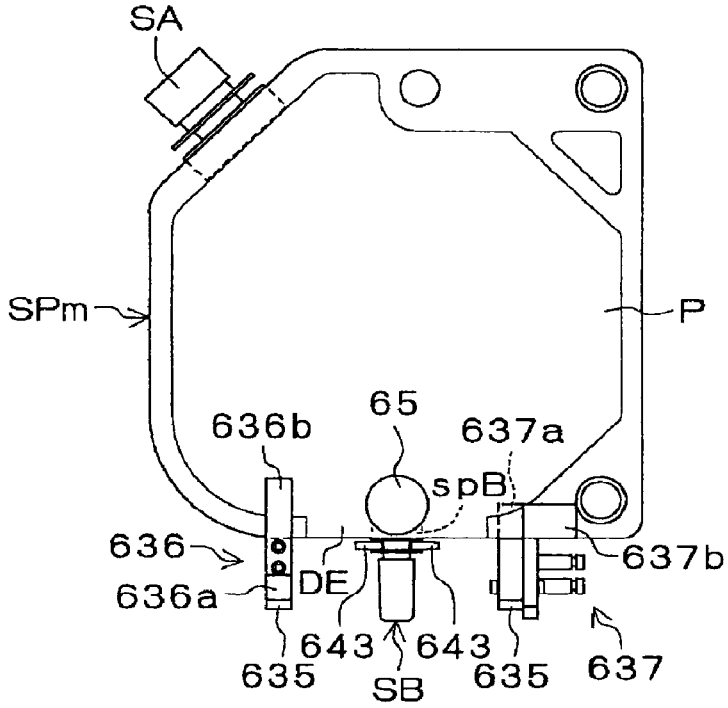

An opener is provided at the above-described opening-insertion position oi. The opener can open the non-sealed lower edge DE of the spout-attached intermediate pouch SPm. As illustrated in FIG. 32(*a*), after the positioned lower edge DE of the spout-attached intermediate pouch SPm is suction gripped by a pair of suction pads 65 constituting the opener, the lower edge DE of the spout-attached intermediate pouch SPm opens when the suction pads 65 depart from each other. Then, as illustrated in FIG. 32(*b*), the installation portion spB of the outlet spout SB can be inserted into the opened lower edge DE of the spout-attached intermediate pouch SPm when the cam mechanism 644 raises the base plate 641 at the positioning position pd.

Figure 33A:
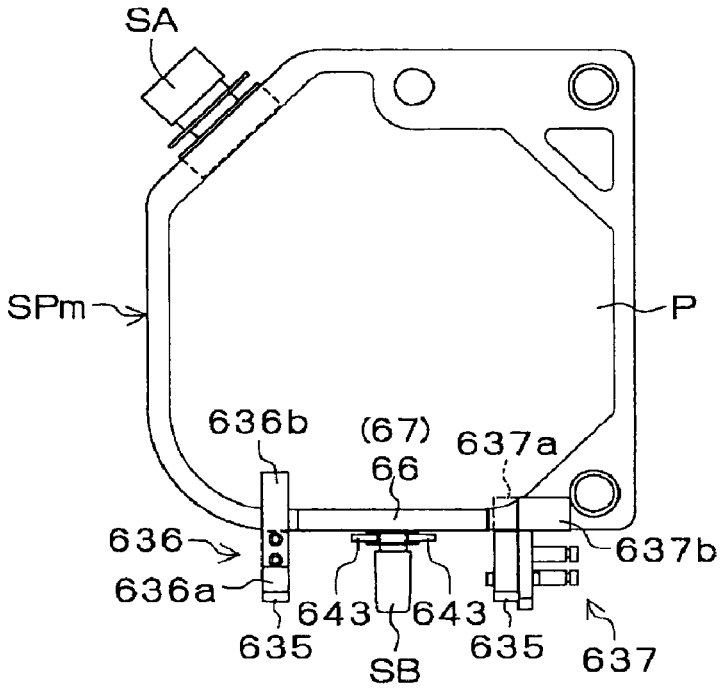
FIGS. 33(*a*) and 33(*b*) are views illustrating an operation for heat sealing an outlet spout together with a spout-attached intermediate pouch and a cooling operation that can be performed by the second spout installation section illustrated in FIG. 26.
Figure 33B:
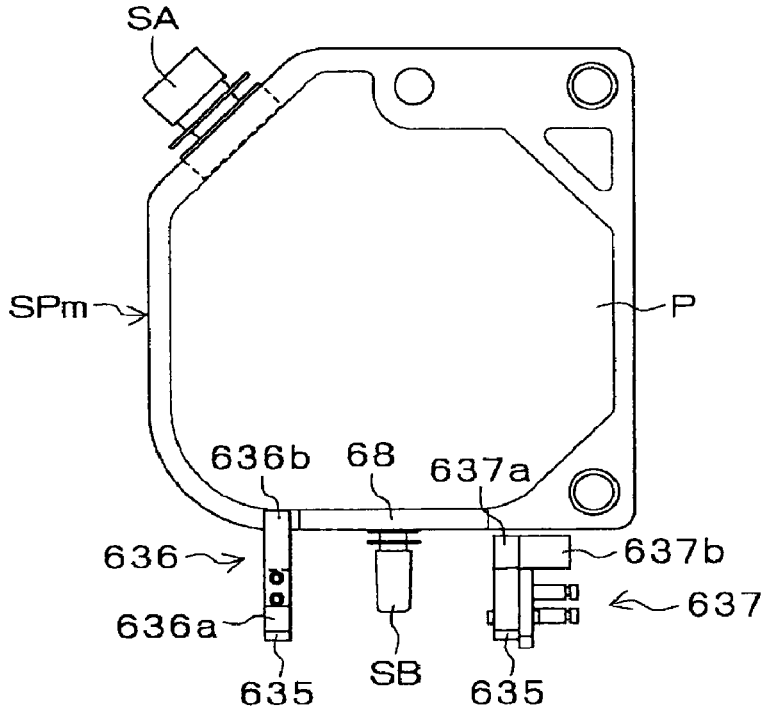

The seal bars are provided at the above-described first seal position s1 and the second seal position s2. The cooling bars are provided at the cooling position c. The spout-attached intermediate pouch SPm, after the installation portion spB of the outlet spout SB is inserted into the opened lower edge DE at the opening-insertion positions oi, is successively conveyed to the first seal position s1 and the second seal position s2. Then, as illustrated in FIG. 33(*a*), the outlet spout SB is heat sealed with the lower edge DE of the pouch P by seal bars 66 and 67. Subsequently, the outlet spout SB is conveyed to the cooling positions c. Then, as illustrated in FIG. 33(*b*), the heat sealed portion is cooled by cooling bars 68. In this case, as illustrated in FIG. 33(*b*), after the rotary piece 636*b* of the positioning grip member 637 releases the gripping of the pouch P, the positioning member 636 and the positioning grip member 637 shift downward.

As described above, when the spout installation device 1 installs the inlet spout SA and the outlet spout SB onto the pouch P, the upper inclined edge SE and the lower edge DE of the pouch P onto which respective spouts can be installed are positioned each time by the positioning unit 23 and the pouch transport unit 24 of the pouch supply section 2 and the positioning-gripping mechanism 63 of the second spout installation section 6. Therefore, in the installation of respective spouts onto the pouch P, the inlet spout SA and the outlet spout SB can be accurately installed onto appropriate positions on the pouch P without being adversely influenced by the dimension accuracy and curvature of the pouch P itself or a deflection of the pouch P that may occur due to the weight of the inlet spout SA that is previously installed.

Further, according to the above-described spout installation device 1, the clamper-opener 24D of the pouch transport unit 24 opens the upper inclined edge SE of the pouch P that is preliminarily positioned by the positioning unit 23. The opened upper inclined edge SE of the pouch P is coupled with the installation portion spA of the spout SA so that the flange fA2 of the spout SA is held in a state where the installation portion spA of the spout SA is slightly separated from the upper inclined edge SE of the pouch P. Then, in a state where the pouch P is held by the auxiliary clamper 24E so as to be variable in orientation and position, the spout installation device 1 releases the pouch P being suction held by the clamper-opener 24D and positions the pouch P by pressing the upper inclined edge SE of the pouch P against the flange fA2 of the spout SA. As described above, the above-described spout installation device 1 performs a two-step positioning so that the spout SA can be accurately installed on the upper inclined edge SE of the pouch P.

Further, according to the above-described spout installation device 1, the positioning member 636 and the positioning grip member 637 cooperatively position the spout-attached intermediate pouch SPm by slightly raising the lower edge DE of the spout-attached intermediate pouch SPm that is hung in a freely swingable state by the first clamp mechanism 62. Therefore, the spout installation device 1 can accurately install the outlet spout SB onto the lower edge DE of the spout-attached intermediate pouch SPm while the spout-attached intermediate pouch SPm is carried in a hanging state.

The spout installation device according to the above-described embodiment is configured to install two spouts, i.e., the inlet spout SA and the outlet spout SB, on a pouch. However, the present invention is not limited to the above-described spout installation device. It is needless to say that the present invention can be also applied to another spout installation device that is configured to install, for example, three or more spouts on a pouch.

Moreover, in the above-described embodiment, the spout installation device installs the spouts on a pouch having the gusset portion GP. However, the present invention is not limited to the above-described embodiment. It is needless to say that the present invention can be also applied in a case where spouts are installed on a flat type pouch that has no gusset portion.

INDUSTRIAL APPLICABILITY

As described above, the spout installation device according to the present invention can position a spout installation edge of a pouch onto which a spout can be installed each time when each spout is installed on the pouch. Therefore, the spout installation device according to the present invention is useful to accurately install a plurality of spouts onto correct positions on the pouch without being adversely influenced by the dimension accuracy and curvature of the pouch itself or a deflection of the pouch that may occur due to the weight of a previously installed spout, at the time when each spout is installed on the pouch.

One positioning means of the spout installation device is preferable to cause the pouch transport unit to couple an opened spout installation edge of the pouch preliminarily positioned by the positioning unit with an installation portion of the spout so that a flange portion of the spout is held in a state where the flange portion of the spout is slightly separated from the spout installation edge of the pouch. Then, in a state where the pouch is held by the auxiliary holding means so as to be variable in orientation and position, the pouch is positioned by pressing the spout installation edge of the pouch against the flange portion of the spout. Therefore, the spout installation device can be preferably used to accurately install the spout onto the spout installation edge of the pouch.

Further, one positioning means of the spout installation device can position the pouch by pressing the positioning member against the spout installation edge of the pouch that is hung in a freely swingable state by the pouch hanging means. Therefore, the spout installation device can be preferably used to accurately install the spout onto the spout installation edge of the pouch while the pouch is carried in a hanging state.

The invention claimed is:

1. A spout installation device that can install a plurality of spouts onto a pouch, comprising:

a pouch supply section for supplying a pouch;

a plurality of spout supply sections for respectively supplying a plurality of spouts; and a plurality of spout installation sections for installing the spouts, which are respectively supplied by the plurality of spout supply sections, onto the pouch supplied by the pouch supply section, wherein a plurality of positioning means are provided to position spout installation edges of the pouch onto which respective spouts can be installed each time when respective spouts are installed on the pouch.

2. The spout installation device according to claim 1, wherein one positioning means of the plurality of positioning means includes, a spout holding member that holds a spout, a positioning unit that positions the pouch by causing the spout installation edge of the pouch to abut, and a pouch transport unit that includes a holding opening means for opening the spout installation edge while holding the pouch positioned by the positioning unit and an auxiliary holding means for holding the pouch to be variable in orientation and position, wherein the holding opening means of the pouch transport unit opens the spout installation edge while holding the pouch positioned by the positioning unit, the opened spout installation edge of the pouch is coupled with an installation portion of the spout by conveying the pouch in this state so that a flange portion of the spout is held in a state where the flange portion of the spout is slightly separated from the spout installation edge of the pouch, and the holding of the pouch by the holding opening means is released in a state where the pouch is held by the auxiliary holding means, to cause the pouch and the spout to approach to each other, thereby positioning the pouch by pressing the spout installation edge of the pouch against the flange portion of the spout.

3. The spout installation device according to claim 1, wherein one positioning means of the plurality of positioning means includes, pouch hanging means for hanging the pouch in a freely swingable state; and a positioning member that can approach to and depart from the spout installation edge of the pouch that is hung by the pouch hanging means, wherein the pouch is positioned by pressing the positioning member against the spout installation edge of the pouch that is hung by the pouch hanging means.

* * * * *